US009732567B2

(12) United States Patent
Hayes

(10) Patent No.: US 9,732,567 B2
(45) Date of Patent: Aug. 15, 2017

(54) INTERCHANGEABLE BAIL LINK APPARATUS AND METHOD

(71) Applicant: H&H Drilling Tools, LLC, Houston, TX (US)

(72) Inventor: Michael W. Hayes, Houston, TX (US)

(73) Assignee: H&H DRILLING TOOLS, LLC, Houston, TX (US)

( * ) Notice: Subject to any disclaimer, the term of this patent is extended or adjusted under 35 U.S.C. 154(b) by 0 days.

(21) Appl. No.: 14/811,486

(22) Filed: Jul. 28, 2015

(65) Prior Publication Data

US 2016/0115744 A1 Apr. 28, 2016

Related U.S. Application Data

(60) Provisional application No. 62/029,989, filed on Jul. 28, 2014.

(51) Int. Cl.
*E21B 19/06* (2006.01)

(52) U.S. Cl.
CPC ..... *E21B 19/06* (2013.01)

(58) Field of Classification Search
CPC ..... E21B 19/06; E21B 19/16; E21B 19/07
See application file for complete search history.

(56) References Cited

U.S. PATENT DOCUMENTS 1,552,527 A * 9/1925 Wilcox ..... E21B 19/06 294/90
2,048,208 A 7/1936 Young et al.
2,070,114 A 2/1937 Burlingame et al.
2,150,581 A 3/1939 De Coursey
2,613,102 A 10/1952 Roberson
2,616,747 A * 11/1952 Ratigan ..... E21B 19/06 294/102.2
3,063,509 A * 11/1962 Guier ..... E21B 19/00 173/151

(Continued)

FOREIGN PATENT DOCUMENTS

WO WO2011162617 12/2011

OTHER PUBLICATIONS

PCT International Search Report and Written Opinion for international patent application serial No. PCT/US15/42497.

*Primary Examiner* — Matthew R Buck
*Assistant Examiner* — Aaron Lembo
(74) *Attorney, Agent, or Firm* — Garvey, Smith & Nehrbass, Patent Attorneys, LLC; Julia M. FitzPatrick

(57) ABSTRACT

An interchangeable elevator bail link system and method for changing elevator bail length and load carrying configurations during rig operations, wherein an upper bail section is provided comprising a connection for a link tilt system of a top drive or traveling block, and further comprising a connector for connecting to a corresponding connector located on one or more lower bail sections of differing tonnage capacities and lengths, wherein the upper bail section connector and lower bail section connector comprise male and female profiles of corresponding size, shape and location, so that when the connector of the lower bail section is aligned in nonparallel relation to the connector of the upper bail section, which is attached to a link tilt system, movement of the top drive or traveling block in an upwards direction will cause the lower bail section to rotate to a position parallel with the upper bail section.

54 Claims, 15 Drawing Sheets

(56) References Cited

U.S. PATENT DOCUMENTS 3,351,372 A * 11/1967 Marks ..... E21B 19/04 254/401
3,368,699 A * 2/1968 Scaggs ..... E21B 19/155 175/85
3,461,666 A 8/1969 Burstall
3,777,046 A 12/1973 Schiavone
3,857,450 A * 12/1974 Guier ..... E21B 19/20 173/215
3,996,737 A 12/1976 Burstall
4,421,179 A 12/1983 Boyadjieff
4,421,447 A 12/1983 Gudgel et al.
4,489,794 A 12/1984 Boyadjieff
4,791,999 A * 12/1988 Skeie ..... E21B 3/02 173/164
4,793,422 A 12/1988 Krasnov
4,800,968 A 1/1989 Shaw et al.
5,529,316 A 6/1996 Mattila
5,755,289 A 5/1998 Angman et al.
5,906,450 A 5/1999 Ng
6,520,709 B1 2/2003 Mosing et al.
6,622,796 B1 * 9/2003 Pietras ..... E21B 21/106 166/379
6,832,658 B2 * 12/2004 Keast ..... E21B 3/02 166/77.52
7,296,630 B2 11/2007 Severin et al.
7,303,021 B2 * 12/2007 Schats ..... E21B 19/06 166/379
7,360,589 B2 4/2008 Moncus et al.
7,681,631 B2 * 3/2010 Thomas, Jr. ..... E21B 3/04 166/378
8,356,674 B2 * 1/2013 Murray ..... E21B 19/07 166/380
8,978,961 B2 3/2015 Lutzhoft et al.
2006/0191690 A1 8/2006 Severin et al.
2013/0105168 A1 5/2013 Overland
2013/0202346 A1 * 8/2013 Hodging ..... B66C 3/005 403/113
2014/0090856 A1 4/2014 Pratt et al.
2016/0090794 A1 * 3/2016 Holck ..... E21B 19/02 166/352
2016/0145954 A1 * 5/2016 Helms ..... E21B 19/06 175/57

* cited by examiner 600
604
610
612
716
620
624
628
630
660
752
756
712
608

624'
630'
660'
605
604
609
4

766
762
752
756

675
900
901
645
3

603
710
750
6

200
208
209
210
228
204
260'
202
230'
350'
220
320'
352
354
350
228'
220
205
340'
350'
230
202
260
203
209
340
228
350
210
12A
340
228
350
310
903
204
902
346
12
12
209
230
356
320
260
230
340
228
350
15
16
210
260
209
16
208
203
202
350'
14
14
15
228'
220
229,229'
200

FIG. 29
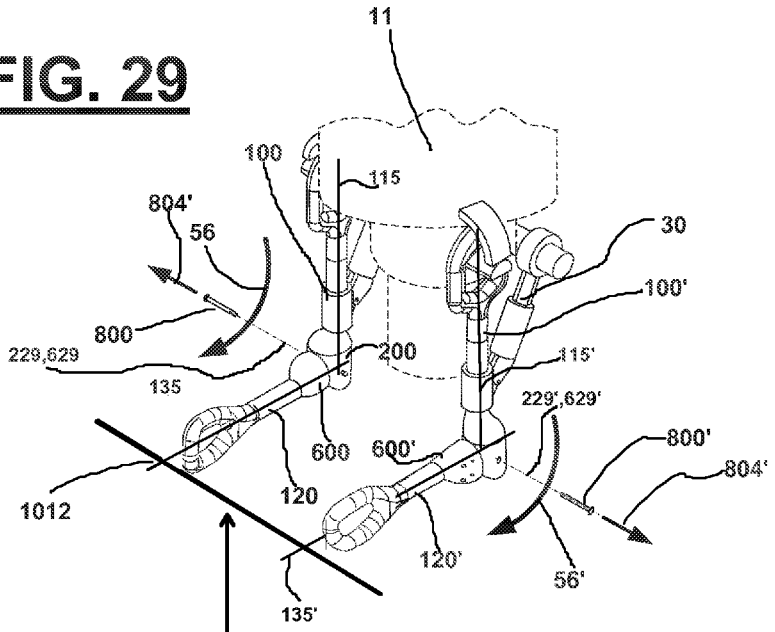
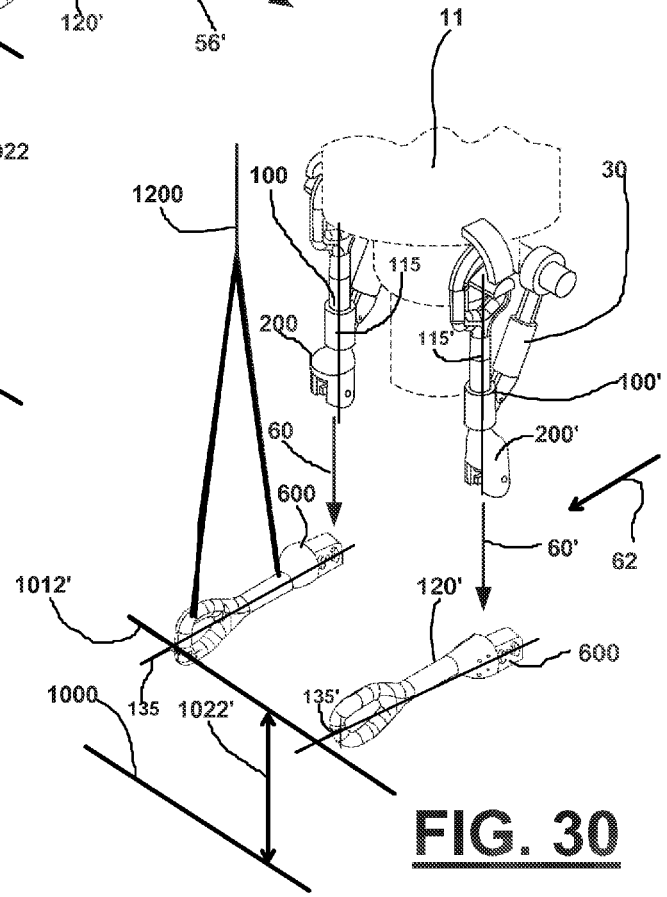
FIG. 30

HOLDING DRILL STEM IN PLACE

REMOVING ARMS & LAYING THEM ON DECK FLOOR

INTERCHANGEABLE BAIL LINK APPARATUS AND METHOD

CROSS-REFERENCE TO RELATED APPLICATIONS

Priority of U.S. Provisional Patent Application Ser. No. 62/029,989, filed on Jul. 28, 2014, which is hereby incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND

Various embodiments relate to elevator bail link systems and methods wherein the overall length and/or capacity (e.g., tonnage capacity) of an elevator bail or link system may be changed.

The hoisting system of a drilling rig includes a set of elevator bails or links which comprise the linkage between the traveling block/top drive and the hoisting elevator.

In a top drive hoisting system, these elevator bails/links are also equipped with a link tilt system mechanically connected to the bails. The link tilt system can tilt the connected bails/links during rig operations, for example, toward the v-door, mouse-hole, and/or derrick racking board while tripping drill pipe or running casing.

During the drilling of an oil and gas well, it is often necessary to change the configuration of the elevator bails, typically due to the need for additional length and/or tonnage capacity. For instance, the rig may utilize elevator bails with a 9 foot (7.7 Meter) length and a 350 Ton (317,514 Kilograms) capacity during drilling/tripping operations with drill pipe, then change to 18 foot (5.5 Meter) 500 Ton (453,592 Kilograms) bails during casing running operations to provide clearance for fillup tools, casing running tools, cementing heads, and other devices as well as load capacities for casing strings which are generally heavier than the drill string.

In prior art systems the process of changing elevator bails typically requires disconnecting the link tilt assembly and possibly reconnecting the link tilt assembly to the "casing" set of bails, depending on whether link tilt is needed for the casing operation. In addition, after the casing is run the reverse generally occurs, i.e. the casing bails are removed and the drilling/tripping bails are re-installed.

Prior art methods of changing bails is time consuming, and typically occurs at a point when the rig is "out of the hole" so that the rig generally cannot perform other operations during the changing of bails. Consequently no progress is being made on the well at this point, commonly referred to as "nonproductive time", and may typically take one or more hours, for example 1 or more hours on a land rig and 3 or 4 or more hours on a deep water rig. This time frame can currently cost the operator increased rig time costs, which can range from approximately $2,000/hour on a land rig to as much as $75,000/hour on an ultra deepwater rig. Also, as there is no drill pipe or casing in the well, the well is susceptible to either flow of hydrocarbons or loss of fluid in the well, which is difficult, and may be impossible to mitigate without drill pipe or casing being in the well acting as a conduit for transporting weighted fluids into the well at a point low enough to address the problem flow of hydrocarbons or loss of fluid in the well.

In addition the process of disconnecting and potentially reconnecting the link tilt mechanism can be dangerous in that it involves personnel working at heights on elevated platforms, work baskets, or man riding hoists, removing and potentially reconnecting hardware that could be dropped to the rig floor, and maneuvering the long bails into and out of the rig floor area.

There is thus a need in the art for a system and method for interchanging elevator bails or links, for addressing one or more of the above identified difficulties in the prior art, which include but are not limited to such as performing different oil rig operations, that is quick and efficient, and to lessen non-productive rig time and associated cost.

There is also a need in the art for a system and method for interchanging elevator bails or links that will mitigate or lessen the nonproductive time which can result in flow of hydrocarbons or loss of fluid in the well that occurs during non-productive rig time.

There is also a need in the art for a system and method for interchanging elevator bails or links for performing different oil rig operations that is safer for rig personnel.

In the prior art, for example U.S. Pat. No. 6,520,709, the art requires assembly horizontally on the warehouse floor or rig deck of an elevator link system with different length components, with mechanical or human assistance to align the sections or components, and therefore does not accomplish the objective of safer and more efficient means of changing elevator bail configurations at the rig floor. In addition the prior art configuration does not meet industry specifications for load carrying capacities (API 8c).

BRIEF SUMMARY

Various embodiments relate to elevator bail link systems and methods wherein the overall length and/or tonnage capacity of an elevator bail or link system may be changed.

Various embodiments provide for an interchangeable bail link system and method, designed to provide a safe and efficient means to change elevator length and load carrying configurations above the rig floor, on the rig floor, on the rig deck, or in the warehouse.

Various embodiments provide an interchangeable elevator bail link system and method that enables a quick connect and quick disconnect of bail portions in order to change tonnage capacity and length of a bail assembly.

Various embodiments provide an interchangeable elevator bail link system and method that enables transfer of the load carrying capability from an upper bail section to a lower bail section and subsequently to the elevator and tubular string.

Various embodiments provide an interchangeable elevator bail link system and method that utilizes movement of a top drive or traveling block and/or an air hoist, and/or a hoisting elevator to effect the connection between upper and lower bail portions.

Various embodiments provide an interchangeable elevator bail link system and method that enables safe, efficient and cost-effective change of bail assembly configuration, length and tonnage capacity.

In various embodiments is provided an upper bail portion, detachably connectable to a link tilt system of a top drive or traveling block, and one or more lower bail portions, detachably connectable to an elevator, wherein each lower bail portion may comprise different lengths and/or tonnage capacities.

In various embodiments is provided a method of changing the overall length and/or tonnage capacity of an elevator bail or link system, which may be performed without having to detach or remove entire elevator bails and/or link from the link tilt system of a top drive or traveling block, and without having to remove the link tilt assembly from the traveling block or top drive.

In various embodiments the upper and lower bail portions can each comprise a shaft portion and eyelet or loop portion.

In various embodiments the upper bail portion can further comprise a connection area for detachably connecting to the lower bail portion, which connection area may comprise slots or recesses, and/or male splined connectors for example.

In various embodiments the lower bail portion can comprise a connection area for detachably connecting to the upper bail portion.

In various embodiments the detachable connection between the upper and lower bail portions can include rods, lugs, tabs, shanks, trunnions, and/or pins and/or male/female splined connectors in the upper bail portion, which items correspond to the size, shape and location of the respective rods, lugs, tabs, shanks, trunnions, and/or pins and/or male/female splined connectors of the lower bail portion.

In various embodiments, a method of changing the overall length and/or tonnage capacity of an elevator bail or link system is provided comprising the steps of (a) providing first upper and first lower bail sections which are detachably connectable to each other, (b) connecting the first upper and first lower bail section to a link tilt system of a top drive or traveling block;

(c) while the first upper bail section remains connected to the tilt system, detaching the first lower bail section from the first upper bail section;

(d) selecting a second lower bail section having a different tonnage rating and/or size than the first lower bail section; and (e) detachably connecting the second lower bail section to the first upper bail section while the first upper bail section remains connected to the tilt system.

In various embodiments the first upper bail link in steps "b" and "c" can be and remain connected to the traveling block and/or top drive (such as where a link tilt system is omitted on the rig).

In various embodiments the first upper bail link in steps "b" and "c" can be and remain connected to the traveling block and/or top drive and/or link tilt system.

In various embodiments step "e" changes the overall length and/or tonnage capacity of an elevator bail or link system.

In various embodiments the first upper and first lower bail sections each have a longitudinal axis, and when connected to each other in step "a" the longitudinal axes are parallel to each other.

In various embodiments the first upper and first lower bail sections each have a longitudinal axis, and when detaching from each other in step "c", the longitudinal axes change from being parallel to each other, to not being parallel (and/or being skewed).

In various embodiments when detaching from each other the longitudinal axes move within the same plane from being parallel to not being parallel. In various embodiments, during step "c" the longitudinal axes rotate relative to each other at least a predefined amount of rotation between the first upper bail section and the first lower bail section. In various embodiments the predefined amount of angular rotation can occur in the same plane. In various embodiments the predefined amount of angular rotation can be at least 5, 10, 15, 20, 25, 30, 35, 40, 45, 50, 55, 60, 65, 70, 75, 80, 85, and/or 90 degrees of rotation in the same plane. In various embodiments the amount of rotation in the same plane can vary between any two of the above specified minimum amounts of rotation. In various embodiments the predefined amount of angular rotation can be such that the upper bail section rotates about an which I perpendicular to the longitudinal axis of the lower bail section. In various embodiments the predefined amount of angular rotation can be such that the lower bail section rotates about an which I perpendicular to the longitudinal axis of the upper bail section.

In various embodiments the second lower bail in step "d" is selected from a set of bail sections having differing predefined amounts for tonnage ratings and/or length ratings. The lower bail sections can have almost infinite tonnages or lengths, but practically would range from 150-1500 Tons (13,607-1,360,777 Kilograms) and 4-40 feet (1.22-12.2 meters) in length. In various embodiments the second lower bail section in step "e", is connected to the first upper bail section by rotating in a single plane the longitudinal axis of the second lower bail section relative to the longitudinal axis of the first upper bail by at least a predefined amount of angular rotation. In various embodiments the predefined amount of angular rotation between the second lower bail section and the first upper bail section can be at least 5, 10, 15, 20, 25, 30, 35, 40, 45, 50, 55, 60, 65, 70, 75, 80, 85, and/or 90 degrees of rotation in the same plane. In various embodiments the amount of rotation in the same plane can vary between any two of the above specified minimum amounts of rotation. In various embodiments the longitudinal axis of the second lower bail section is rotated from a non-parallel and/or skewed orientation to a parallel orientation with the longitudinal axis of the first upper bail section when making the connection in step "c".

In various embodiments the second lower bail section in step "e", is connected to the first upper bail section and has a change in effective length from the first lower bail section by at least a predefined change in effective length. In various embodiments the predefined change in effective length can be at least 1, 2, 4, 5, 6, 8, 10, 15, 20, 25, 30, 35, 40, 45, 50, 55, 60, 65, 70, 75, and/or 80 feet (0.3, 0.6, 1.2, 1.5, 1.8, 2.4, 3.0, 4.6, 6.1, 7.6, 9.1, 10.7, 12.2, 13.7, 15.2, 16.8, 18.3, 19.8, 21.3, 22.9 and/or 24.4 meters). In various embodiments the change in effective length can vary between any two of the above specified minimum changes in effective length. In various embodiments the predefined change in effective length can be either a positive or negative change in the effective length.

In various embodiments the second lower bail section in step "e", is connected to the first upper bail section and has a change in effective load carrying capacity relative to the first lower bail section by at least a predefined change in effective load carrying capacity. In various embodiments the predefined change in effective load carrying capacity can be at least 50, 100, 200, 400, 500, 600, 800, 1000, 1500, 2000, 2500, 3000, 3500, 4000, 4500, 5000, 5500, 6000, 6500, 7000, 7500, and/or 8000 Tons (45,359; 90,718; 181,436; 272,155; 362,873; 453,592; 544,310; 725,747; 907,184; 1,360,777; 1,814,369; 2,267,961; 2,721,554; 3,175,146; 3,628,738; 4,082,331; 4,535,923; 4,989,516; 5,443,108; 5,896,700; 6,350,293; 6,803,885; and/or 7,257,477 Kilograms). In various embodiments the change in effective load carrying capacity can vary between any two of the above specified minimum changes in effective capacity. In various embodiments the predefined change in effective load carrying capacity can be either a positive or negative change in the effective load carrying capacity.

In one embodiment is provided an interchangeable bail linking apparatus comprising an upper bail section of fixed length, having a connection for a link tilt system; multiple interchangeable lower bail sections of varying lengths and/or tonnage capacities depending, for use in different drilling rig applications; a quick connect/quick disconnect connector system for facilitating a quick-connect and quick-disconnect between the upper and interchangeable lower bail section, and to also facilitate a safe and efficient interchange of the lower sections of the bail assembly.

In one embodiment is provided a system and method for changing the bail configuration in less than a predefined amount of time. In various embodiments the predefined amount of time is less than 2, 3, 4, 5, 10, 15, 20, 25, 30, 35, 40, 45, 50, 55, and/or 60 minutes. In various embodiments the predefined amount of time is between any two of the above specified predefined amounts of time. In various embodiments the bail system includes upper and lower bail link portions and during the change the upper bail link portions remains connected to the rid and/or link tilt system.

The interchangeable bail link method and system therefore significantly lessens the non-productive rig time and provides a cost savings of around $2,000 to more than $75,000, per hour of time saved.

In various embodiments an interchangeable elevator bail link system for changing elevator length and load carrying configurations during oil rig operations comprises:

(a) one or more upper bail sections comprising first and second ends, wherein the first end of the upper bail section comprises a connection for a link tilt system and/or of a top drive or traveling block, and the second end of the upper bail section comprises a connector comprising female profiles for connecting to a lower bail section; and (b) one or more lower bail sections wherein each of the one or more lower bail sections comprise a connection for connecting to an elevator and a connector comprising male profiles; and (c) wherein the male and female profiles are of corresponding size, shape and location, so that when the connector of the lower bail section is aligned in nonparallel relation with the connector of the upper bail section, movement of the top drive or traveling block in an upwards direction, while the upper bail section is secured to the link tilt system, will cause the lower bail section to rotate to a position parallel with the upper bail section and connect the upper and lower bail sections.

In various embodiments one or more lower bail sections include lower bail sections comprising different lengths and tonnage capacities, wherein said lower bail sections may be interchangeably connected to the upper bail section while the upper bail system remains attached to the link tilt system of the top drive or traveling block.

In various embodiments an upper bail section comprises a fixed length.

In various embodiments an upper bail section comprises a fixed length of approximately five feet (1.5 Meters) and a 500 Ton (453,592 Kilograms) capacity, and at least one lower bail section comprises a length of four feet (1.22 Meters) and a 350 Ton (317514 Kilograms) capacity for connecting to the upper bail assembly during drilling and tripping operations, and wherein at least one of the lower bail sections comprises a length of thirteen feet (4.0 Meters) and a 500 Ton (453,592 Kilograms) capacity for connecting to the upper bail assembly for running casing operations. These tonnages and lengths are only 1 example, numerous suitable combinations of tonnages and lengths are possible.

In various embodiments an interchangeable elevator bail link method for changing bail assembly configuration, length and tonnage capacity during oil rig operations comprises:

(a) providing an upper bail section comprising first and second ends, wherein the first end of the upper bail section comprises a connection point for a link tilt system of a top drive or traveling block and the second end of the upper bail section comprises a connector for connecting to a lower bail section; and (b) selecting a lower bail section comprising a fixed length and tonnage capacity for use in a particular oil rig operation, and further comprising a connection point for connecting to a hoisting elevator and a connector for connecting to an upper bail;

(c) positioning the lower bail section in horizontal or nonparallel relation to the upper bail section, which upper bail section is positioned along a longitudinal axis;

(d) raising the lower bail section until positioning holes located on each of the lower and upper bail section connectors align;

(e) inserting a positioning pin through positioning holes of the lower and upper bail connectors;

(f) raising the top drive or traveling block to cause the lower bail section to rotate to a position that is in parallel or vertical relation to the upper bail section, wherein the connectors of the lower bail and upper bail sections mesh; and (g) connecting the lower bail section to a hoisting elevator.

In various embodiments the method includes a step of using a locking system to prevent the lower bail section from rotating back to a horizontal position.

In various embodiments the method further comprises the steps of removing the locking component and moving a hoisting elevator to cause the lower bail section to return to a horizontal or nonparallel position, and disconnecting the lower bail section from the hoisting elevator and upper bail section, while the upper bail section remains attached to the link tilt system.

In various embodiments the method further comprises the steps of removing the locking component and moving the top drive or traveling block to cause the lower bail section or sections to return to a horizontal or nonparallel position, and disconnecting the lower bail section from the hoisting elevator and upper bail section, while the upper bail section remains attached to the link tilt system and/or top drive or traveling block. In various embodiments the method further comprises the steps of removing the locking component and securing the lower bail to an air hoist wherein movement of the air hoist causes the lower bail section to return to a horizontal or nonparallel position.

In various embodiments the method further comprises the steps of selecting a lower bail section having a different length and tonnage capacity and repeating steps (d)-(g).

In various embodiments an interchangeable bail system comprises (a) an upper bail section (b) multiple lower bail sections of varying lengths and tonnage capacities, and (c) a connector system of various configurations.

In various embodiments the connector system is rotatably connectable and transfers loads via splines.

In various embodiments the connector incorporates a rotational torque stop.

In various embodiments the securing mechanism is manually placed.

In various embodiments the securing device is automatic.

In various embodiments the securing device is spring loaded.

In various embodiments the securing device is remotely activated.

In various embodiments the splines are tapered end to end to allow easy intermeshing on initial engagement and close tolerances on final engagement.

In various embodiments the splines are tapered along load carrying portions.

In various embodiments the splines are dovetailed on one side or both.

In various embodiments the bail sections are mated directly with opposing profiles.

In various embodiments the bail sections are mated with a ball and recess system.

In various embodiments the bail sections are mated with a grapple system.

In various embodiments the bail sections are threaded together with a male and female connection on each.

In various embodiments the bail sections are threaded together with a male connection on each and a connector between each section.

In various embodiments the upper and lower bail assemblies, and/or the connector, incorporate a locking assembly.

In various embodiments the connector is hydraulically operated.

In various embodiments the connector is pneumatically operated.

In various embodiments, the connector is electrically operated.

In various embodiments, the connector is mechanically operated.

In various embodiments, the connection of the upper and lower bail sections is accomplished by any other suitable means.

In various embodiments the upper bail section is not removably connected to the top drive and/or to the link tilt system and/or a traveling block, for example, when it is desired that it always remain connected to the top drive and/or link tilt system.

In various embodiments the upper bail section may be manufactured as part of a top drive and/or link tilt system and/or traveling block, the upper bail section having means to connect with a lower bail section.

In various embodiments, time saved in changing the bail load carrying capacity as compared to prior art methods of changing out elevator bails, may be 30 minutes to 2 hours or more of time saved.

In various embodiments, the process of changing out a lower bail arm connected to an upper bail arm may be performed in 30, 45, 60, 75, 90, 105, 120, 135, 150, 165, 180, 195, or 210 minutes. In various embodiments time spent can vary between any two of the above specified time intervals.

In various embodiments an interchangeable elevator bail link system for changing elevator length and load carrying configurations during oil rig operations, comprising:

(a) an upper bail section comprising first and second ends and an upper longitudinal axis, wherein the upper bail section is connected to a link tilt system of a top drive or traveling block, and the second end of the upper bail section includes a connector having an upper detachable connecting profile; and (b) one or more lower bail sections wherein each of the one or more lower bail sections includes a lower longitudinal axis, a connector for connecting to an elevator, and a lower detachable connecting profile which can detachably connect to the upper detachable connecting profile of the upper bail section; and (c) the upper and lower detachable connecting profiles are connected to each other by changing state of the upper and lower longitudinal axes from a non-parallel state to a parallel state, and the upper and lower detachable connecting profiles are disconnected from each other by changing state of the upper and lower longitudinal axes from a parallel state to a non-parallel state.

In various embodiments, in changing state of the upper and lower detachable connecting profiles, the lower detachable connecting profile rotates about an axis which is perpendicular to the longitudinal axis of the upper bail section.

In various embodiments, in changing state of the upper and lower detachable connecting profiles, the upper detachable connecting profile rotates about an axis which is perpendicular to the longitudinal axis of the lower bail section.

In various embodiments, the lower detachable connecting profile rotates at between 45 and 90 degrees.

In various embodiments, the lower detachable connecting profile rotates between 45 and 90 degrees.

In various embodiments, in changing state of the upper and lower detachable connecting profiles, the upper and lower bail links rotate relative to each other in the same plane.

In various embodiments, the upper and lower detachable connecting profiles each have at least one cooperating load bearing lug/flank.

In various embodiments, the at least one cooperating load bearing lug/flank of the upper detachable connecting profile has a finite radius of curvature and the cooperating load bearing lug/flank of the lower detachable has a radius of curvature that is substantially the same as but of opposite concavity to the radius of curvature of the load bearing lug/flank of the upper detachable connecting profile and these matching radii of curvature facilitate relative rotation between the upper and lower detachable connecting profiles.

In various embodiments, the upper and lower detachable connecting profiles each have at least first and second cooperating load bearing lug/flanks, wherein the cooperating first load bearing lug/flank of the upper detachable connecting profile has a finite radius of curvature and the cooperating first load bearing lug/flank of the lower detachable has a radius of curvature that is substantially the same as but of opposite concavity to the radius of curvature of the first load bearing lug/flank of the upper detachable connecting profile, the cooperating second load bearing lug/flank of the upper detachable connecting profile has a finite radius of curvature and the cooperating second load bearing lug/flank of the lower detachable has a radius of curvature that is substantially the same as but of opposite concavity to the radius of curvature of the second load bearing lug/flank of the upper detachable connecting profile, and these multiple matching radii of curvature facilitate relative rotation between the upper and lower detachable connecting profiles.

In various embodiments, the upper and lower detachable connecting profiles each have (a) top first and second cooperating load bearing lug/flanks, wherein the cooperating top first load bearing lug/flank of the upper detachable connecting profile has a finite radius of curvature and the cooperating top first load bearing lug/flank of the lower detachable has a radius of curvature that is substantially the same as but of opposite concavity to the radius of curvature of the top first load bearing lug/flank of the upper detachable connecting profile, the cooperating top second load bearing lug/flank of the upper detachable connecting profile has a finite radius of curvature and the cooperating top second load bearing lug/flank of the lower detachable has a radius of curvature that is substantially the same as but of opposite concavity to the radius of curvature of the top second load bearing lug/flank of the upper detachable connecting profile, and (b) bottom first and second cooperating load bearing lug/flanks, wherein the cooperating bottom first load bearing lug/flank of the upper detachable connecting profile has a finite radius of curvature and the cooperating bottom first load bearing lug/flank of the lower detachable has a radius of curvature that is substantially the same as but of opposite concavity to the radius of curvature of the bottom first load bearing lug/flank of the upper detachable connecting profile, the cooperating bottom second load bearing lug/flank of the upper detachable connecting profile has a finite radius of curvature and the cooperating bottom second load bearing lug/flank of the lower detachable has a radius of curvature that is substantially the same as but of opposite concavity to the radius of curvature of the bottom second load bearing lug/flank of the upper detachable connecting profile, and (c) these multiple matching radii of curvature facilitate relative rotation between the upper and lower detachable connecting profiles.

In various embodiments, a detachable rotation rod is rotatably connected to at least one of the upper or lower detachable connecting profiles.

In various embodiments, the one or more lower bail sections include lower bail sections comprising different lengths and tonnage capacities, wherein said lower bail sections may be interchangeably connected to the upper bail section while the upper bail system remains attached to the link tilt system of the top drive or traveling block.

In various embodiments, the upper bail section comprises a fixed length.

In various embodiments, the upper bail section comprises a fixed length of approximately five feet (1.5 Meters) and a 500 Ton (453,592 Kilograms) capacity, and at least one lower bail section comprises a length of four feet (1.2 Meters) and a 350 Ton (317,514 Kilograms) capacity for connecting to the upper bail assembly during drilling and tripping operations, and wherein at least one of the lower bail sections comprises a length of thirteen feet (4.0 Meters) and a 500 Ton (453,592 Kilograms) capacity for connecting to the upper bail assembly for running casing operations.

In various embodiments, a method of operating a drilling rig with an elevator bail link assembly comprising the following steps:

(a) providing an upper bail section comprising:

(i) an upper bail section comprising first and second ends and an upper longitudinal axis, wherein the upper bail section is connected to a link tilt system of a top drive or traveling block, and the second end of the upper bail section includes a connector having an upper detachable connecting profile; and (ii) one or more lower bail sections wherein each of the one or more lower bail sections includes a lower longitudinal axis, a connector for connecting to an elevator, and a lower detachable connecting profile which can detachably connect to the upper detachable connecting profile of the upper bail section; and (iii) the upper and lower detachable connecting profiles are connected to each other by changing the state of the upper and lower longitudinal axes from a non-parallel state to a parallel state, and the upper and lower detachable connecting profiles are be disconnected from each other by changing the state of the upper and lower longitudinal axes from a parallel state to a non-parallel state;

(b) selecting a lower bail section comprising a fixed length and tonnage capacity for use in a particular oil rig operation;

(c) positioning the one or more lower bail sections in horizontal or nonparallel relation to the upper bail section, which upper bail section is positioned along a longitudinal axis;

(d) causing the lower bail section to be raised relative to the upper bail section until positioning holes located on each of the lower and upper bail section connectors align;

(e) inserting a positioning pin through the positioning holes of the lower and upper bail connectors;

(f) causing the lower bail section to rotate relative to the upper bail section to change the state of the upper and lower longitudinal axes from a non-parallel state to a parallel state, wherein the connectors of the lower bail and upper bail sections mesh; and (g) connecting the lower bail section to a hoisting elevator.

In various embodiments, in step "c" in changing state of the upper and the lower detachable connecting profiles, the lower detachable connecting profile rotates about an axis which is perpendicular to the longitudinal axis of the upper bail section.

In various embodiments, in step "c" in changing state of the upper and lower detachable connecting profiles, the upper detachable connecting profile rotates about an axis which is perpendicular to the longitudinal axis of the lower bail section.

In various embodiments, in step "c" the lower detachable connecting profile rotates at between 45 and 90 degrees.

In various embodiments, in step "c" the lower detachable connecting profile rotates between 45 and 90 degrees.

In various embodiments, in step "c" in changing state of the upper and lower detachable connecting profiles, the upper and lower bail links rotate relative to each other in the same plane.

In various embodiments, in step "a" the upper and lower detachable connecting profiles each have at least one cooperating load bearing lug/flank.

In various embodiments, the at least one cooperating load bearing lug/flank of the upper detachable connecting profile has a finite radius of curvature and the cooperating load bearing lug/flank of the lower detachable has a radius of curvature that is substantially the same as but of opposite concavity to the radius of curvature of the load bearing lug/flank of the upper detachable connecting profile and these matching radii of curvature facilitate relative rotation between the upper and lower detachable connecting profiles.

In various embodiments, in step "a" the upper and lower detachable connecting profiles each have at least first and second cooperating load bearing lug/flanks, wherein the cooperating first load bearing lug/flank of the upper detachable connecting profile has a finite radius of curvature and the cooperating first load bearing lug/flank of the lower detachable has a radius of curvature that is substantially the same as but of opposite concavity to the radius of curvature of the first load bearing lug/flank of the upper detachable connecting profile, the cooperating second load bearing lug/flank of the upper detachable connecting profile has a finite radius of curvature and the cooperating second load bearing lug/flank of the lower detachable has a radius of curvature that is substantially the same as but of opposite concavity to the radius of curvature of the second load bearing lug/flank of the upper detachable connecting profile, and these multiple matching radii of curvature facilitate relative rotation between the upper and lower detachable connecting profiles.

In various embodiments, in step "a" the upper and lower detachable connecting profiles each have:

(a) top first and second cooperating load bearing lug/flanks, wherein the cooperating top first load bearing lug/flank of the upper detachable connecting profile has a finite radius of curvature and the cooperating top first load bearing lug/flank of the lower detachable has a radius of curvature that is substantially the same as but of opposite concavity to the radius of curvature of the top first load bearing lug/flank of the upper detachable connecting profile, the cooperating top second load bearing lug/flank of the upper detachable connecting profile has a finite radius of curvature and the cooperating top second load bearing lug/flank of the lower detachable has a radius of curvature that is substantially the same as but of opposite concavity to the radius of curvature of the top second load bearing lug/flank of the upper detachable connecting profile, and (b) bottom first and second cooperating load bearing lug/flanks, wherein the cooperating bottom first load bearing lug/flank of the upper detachable connecting profile has a finite radius of curvature and the cooperating bottom first load bearing lug/flank of the lower detachable has a radius of curvature that is substantially the same as but of opposite concavity to the radius of curvature of the bottom first load bearing lug/flank of the upper detachable connecting profile, the cooperating bottom second load bearing lug/flank of the upper detachable connecting profile has a finite radius of curvature and the cooperating bottom second load bearing lug/flank of the lower detachable has a radius of curvature that is substantially the same as but of opposite concavity to the radius of curvature of the bottom second load bearing lug/flank of the upper detachable connecting profile, and (c) these multiple matching radii of curvature facilitate relative rotation between the upper and lower detachable connecting profiles.

In various embodiments, in step "c" a detachable rotation rod is rotatably connected to at least one of the upper or lower detachable connecting profiles.

In various embodiments, in step "a" the one or more lower bail sections include lower bail sections comprising different lengths and tonnage capacities, wherein said lower bail sections may be interchangeably connected to the upper bail section while the upper bail system remains attached to the link tilt system of the top drive or traveling block.

In various embodiments, the method further comprises the step of using a locking system to prevent the lower bail section from rotating back to a horizontal position.

In various embodiments, the method further comprises the steps of removing the locking component and moving the top drive or traveling block to cause the lower bail section to return to a horizontal or nonparallel position, and disconnecting the lower bail section from the hoisting elevator and upper bail section, while the upper bail section remains attached to the link tilt system.

In various embodiments, the method further comprises the steps of selecting a lower bail section having a different length and tonnage capacity and repeating steps (d)-(g).

In various embodiments, an interchangeable bail system comprising (a) an upper bail section (b) multiple lower bail sections of varying lengths and tonnage capacities, and (c) a connector system of various configurations.

In various embodiments, the connector system is rotatably connectable and transfers loads via splines.

In various embodiments, the connector incorporates a rotational torque stop.

In various embodiments, the securing mechanism is manually placed.

In various embodiments, the securing device is automatic.

In various embodiments, the securing device is spring loaded.

In various embodiments, the securing device is remotely activated.

In various embodiments, the splines are tapered end to end to allow easy intermeshing on initial engagement and close tolerances on final engagement.

In various embodiments, the splines are dovetailed on one side or both.

In various embodiments, the bail sections are mated directly with opposing profiles.

In various embodiments, the bail sections are mated with a ball and recess system.

In various embodiments, the bail sections are mated with a grapple system.

In various embodiments, the bail sections are threaded together with a male and female connection on each.

In various embodiments, the bail sections are threaded together with a male connection on each and a connector between each section.

In various embodiments, the upper and lower bail assemblies, and/or the connector, incorporate a locking assembly.

In various embodiments, the connector is hydraulically operated.

In various embodiments, the connector is pneumatically operated.

In various embodiments, the connector is electrically operated.

In various embodiments, the connector is mechanically operated.

In various embodiments, the connection of the upper and lower bail sections is accomplished by any other suitable means.

In various embodiments, the connection of each of the one or more lower bails to the upper bail is accomplished simultaneously.

In various embodiments, detaching each of the one more lower bail sections from the upper bail for interchanging another set of one or more lower bails is accomplished simultaneously.

In various embodiments, the connection of each of the one or more lower bails is not accomplished simultaneously.

In various embodiments, detaching each of the one or more lower bail sections is not accomplished simultaneously.

In various embodiments, the one or more lower bails are each supported by a single cradle above a floor level while connecting a selected set of one more lower bails or detaching a selected set of one more lower bails.

In various embodiments, the single cradle also supports an elevator.

In various embodiments, the one or more lower bails are each supported by a different cradle above a floor level while connecting a selected set of one more lower bails or detaching a selected set of one more lower bails.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIG. 29 schematically shows the rotational shafts being removed from each of the two sets of male and female connectors of FIG. 28, which will allow the male and female connectors to be separated.

FIG. 30 schematically shows the male and female connectors being separated by the connectors being moved in a direction parallel to the longitudinal axis of one of the connectors (e.g., female connector) and perpendicular to the longitudinal axis of the other of the connectors (e.g. male connector).

DETAILED DESCRIPTION OF THE INVENTION

Figures 1, 2, 3, 4, 5, 6:
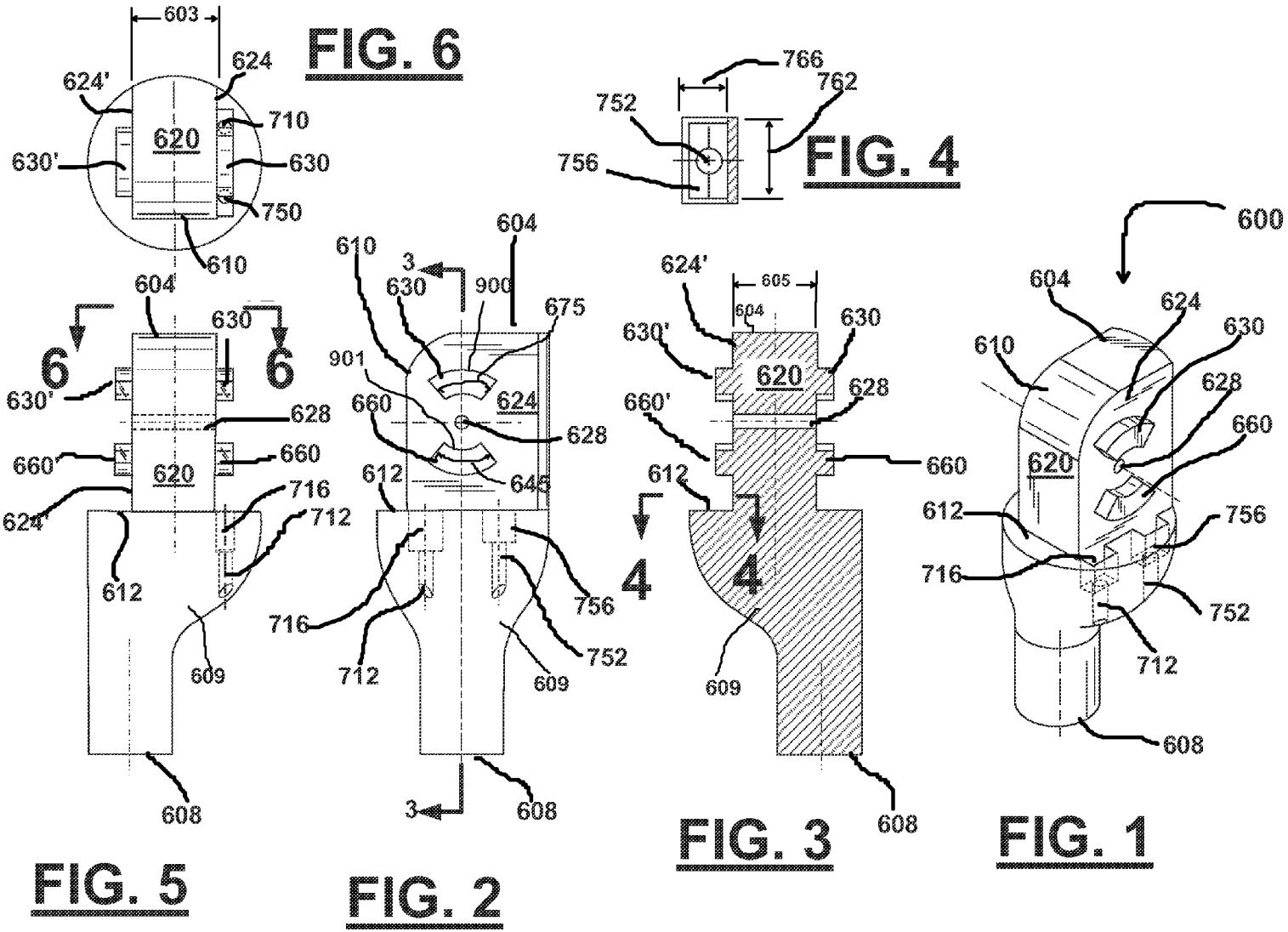
FIG. 1 is a perspective view of one embodiment of a male connector member.
FIG. 2 is a top view of the male connector member of FIG. 1.
FIG. 3 is a sectional view of the male connector member of FIG. 1 taken through lines 3-3 of FIG. 2.
FIG. 4 is a sectional view of the male connector member of FIG. 1 taken through lines 4-4 of FIG. 3.
FIG. 5 is a side view of the male connector member of FIG. 1.
FIG. 6 is a partial side view of the first end of the male connector member of FIG. 1 taken from lines 6-6 of FIG. 5.

In the prior art is used a pair of elevator bails or links attached to a top drive 11 and elevator 13, wherein typical prior art elevator bails or links are one piece bail links with upper and lower eyelet portions for connecting to the top drive or elevator, respectively, and to change the elevator length or tonnage capacity, when switching to another oil rig operation, each of the entire bails or links are required to be removed from the elevator 13 and replaced with a second elevator bail or link of different length and tonnage capacity.

In various embodiments, the interchangeable bail link apparatus, system and method 10 (see FIGS. 27-28) comprises an upper bail portion 100, which can be attached to a female connector 200, and can have longitudinal axis 115. Lower bail portion 120 can be attached to a male connector 600, and can have longitudinal axis 135.

In various embodiments, an upper bail portion 100 may instead comprise a male connector, for connection with a female connector on a lower bail portion 120.

One embodiment provides bail links having upper and lower portions with a quick connect and disconnect allowing the portion of each of the bail links (e.g., upper bail portion 100) not connected to the elevator 13 to be quickly disconnected from the portion actually connected to the elevator 13 with a second link portion so that the entire link will have a different overall length and/or capacity. The male 600 and female 200 connecting portions will be described in detail below.

Male Connector

FIG. 1 is a perspective view of one embodiment of a male connector member 600. FIG. 2 is a top view of the male connector member 600. FIG. 3 is a sectional view of the male connector member 600 taken through lines 3-3 of FIG. 2. FIG. 4 is a sectional view of the male connector member 600 taken through lines 4-4 of FIG. 3. FIG. 5 is a side view of the male connector member 600. FIG. 6 is a partial side view of the first end 604 of male connector member 600 taken from lines 6-6 of FIG. 5.

Lockable male connector 600 can have first end 604, second end 608, enlarged section 609, bore hole 628 (with longitudinal centerline 629), and male extension 620 with two opposing flat planar sections 624 and 624' and height 603.

Figure 17:
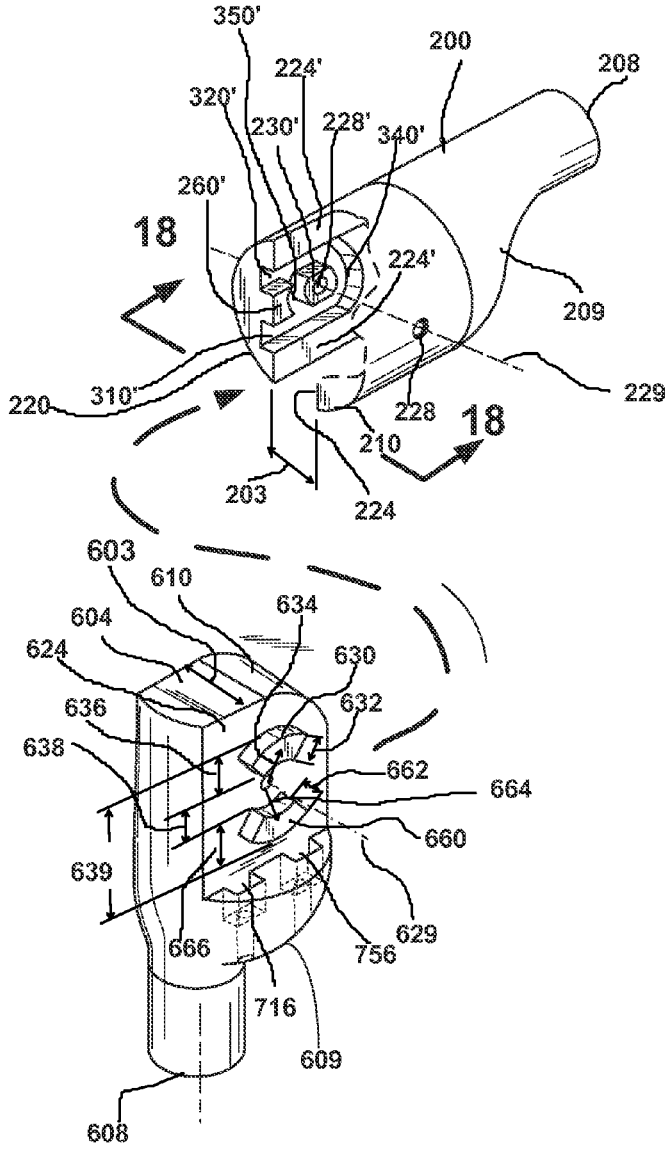
FIG. 17 includes perspective views of both the male and female connector of one embodiment shown ninety degrees relative to each other.

On flat planar section 624 can be first and second load bearing lugs or flanks 630 and 660. Lug 630 can have height 631 and width 632 and be curvilinear, and from longitudinal centerline 629 can have inner radius of curvature 633, middle radius of curvature 634, and outer radius of curvature 635, and can have an overall arc length 645. Lug 660 can have height 661 and width 662 and be curvilinear, and from longitudinal centerline 629 can have inner radius of curvature 663, middle radius of curvature 664, and outer radius of curvature 665, and can have an overall arc length 675. As shown in FIG. 17, there can be a minimum gap 638 between first and second locking lugs 630 and 660. As shown in FIG. 17, there can be a maximum spacing 639 between first and second locking lugs 630 and 660. As shown in FIG. 2, lug 630 can have load bearing surface 900, and lug 660 can have load bearing surface 901.

Flat planar section 624' can be constructed substantially similar to section 624. On flat planar section 624' can be first and second locking lugs 630' and 660'. Locking tab 630' can have height 631' and width 632' and be curvilinear, and from longitudinal centerline 629 can have inner radius of curvature 633', middle radius of curvature 634', and outer radius of curvature 635', and can have an overall arc length 645'. Locking tab 660' can have height 661' and width 662' and be curvilinear, and from longitudinal centerline 629 can have inner radius of curvature 663', middle radius of curvature 664', and outer radius of curvature 665', and can have an overall arc length 675'. Similar to gap 638 shown in FIG. 17, there can be a minimum gap 638' between first and second locking lugs 630' and 660', and there can be a maximum spacing 639' between first and second locking lugs 630' and 660'.

Rotational Locking Mechanism

Figure 7:
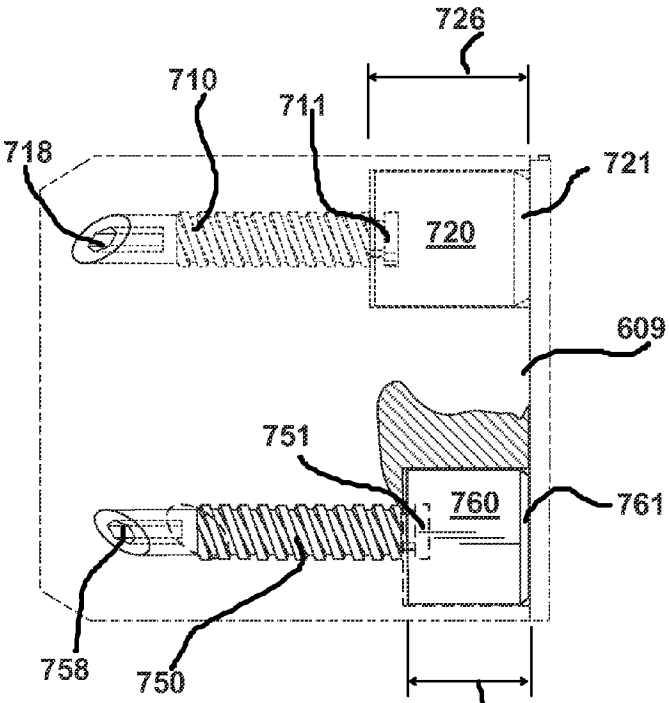
FIG. 7 is an enlarged top view of the male connection member of FIG. 1 showing two locking wedges/tips for rotational locking the male and female connector members of one embodiment, with both locking wedges/tips in a retracted state.
Figure 8:
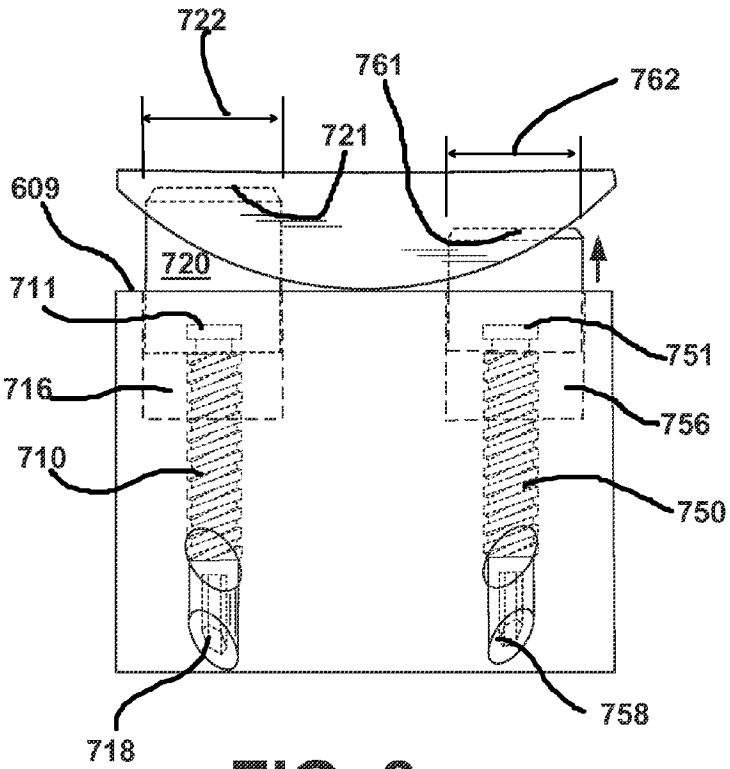
FIG. 8 is an enlarged top view of the male connection member of FIG. 1 showing two locking wedges/tips for rotational locking the male and female connector members of one embodiment, with both locking wedges/tips in an extended state.

FIG. 7 is an enlarged top view of the male connector 600 showing two locking wedges/tips 720,760 for rotational locking the male 600 and female connector 200 members of one embodiment, with both locking wedges/tips 720,760 in a retracted state. FIG. 8 is an enlarged top view of the male connection member 600 showing two locking wedges/tips 720,760 in a partially extended state.

Figure 9:
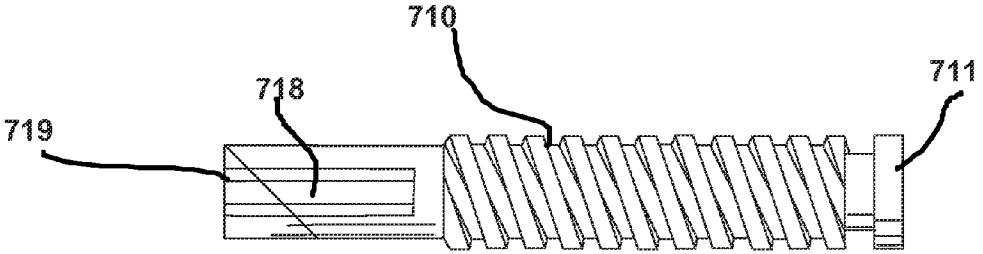
FIG. 9 is a perspective view of a threaded fastener that can be used with the locking wedges/tips shown in FIGS. 8 and 9.

FIG. 9 is a perspective view of a threaded fastener 710, which can comprise head 711 that can be used with the locking wedges/tips 720,760, and connector 718 that can be used to rotate threaded fastener 710 relative to male connector 600/bore hole 712 to extend and retract locking wedge/tip 760. Removed section 719 can be removed from threaded fastener 710 to make the end of threaded fastener 710 follow the contour of the male connector 600 when threaded fastener 710 causes locking wedge/tip 720 to be fully recessed in receiving area 716 (see e.g., FIG. 25). Similarly, removed section 759 can be removed so that threaded fastener 750 also follows the contour of male connector when threaded fastener 750 causes locking wedge/tip 760 to be fully recessed in receiving area 756, and threaded fastener 750 can include connector 758 that can be used to rotate threaded fastener 750 relative to male connector 600/bore hole 752 to extend and retract locking wedge/tip 760.

In one embodiment is provided a relative rotational locking mechanism 700 between female 200 and male 600 connectors which can be activated to lock the lower bail section 150 in the vertical or parallel orientation in relation to the upper bail section 100. In one embodiment can be provided at least one locking wedge or tab 720 which can be slidable relative to both male 600 and female 200 connectors. In one embodiment locking wedge/lug 720 can be rotatably connected to a threaded fastener 710 and threaded fastener 710 can be threadably connected to male connector 600. In one embodiment male connector 600 can include a receiving area or pocket 716 for which locking wedge/lug 720 can be retracted into and/or extended at least partially out of.

Figure 25:
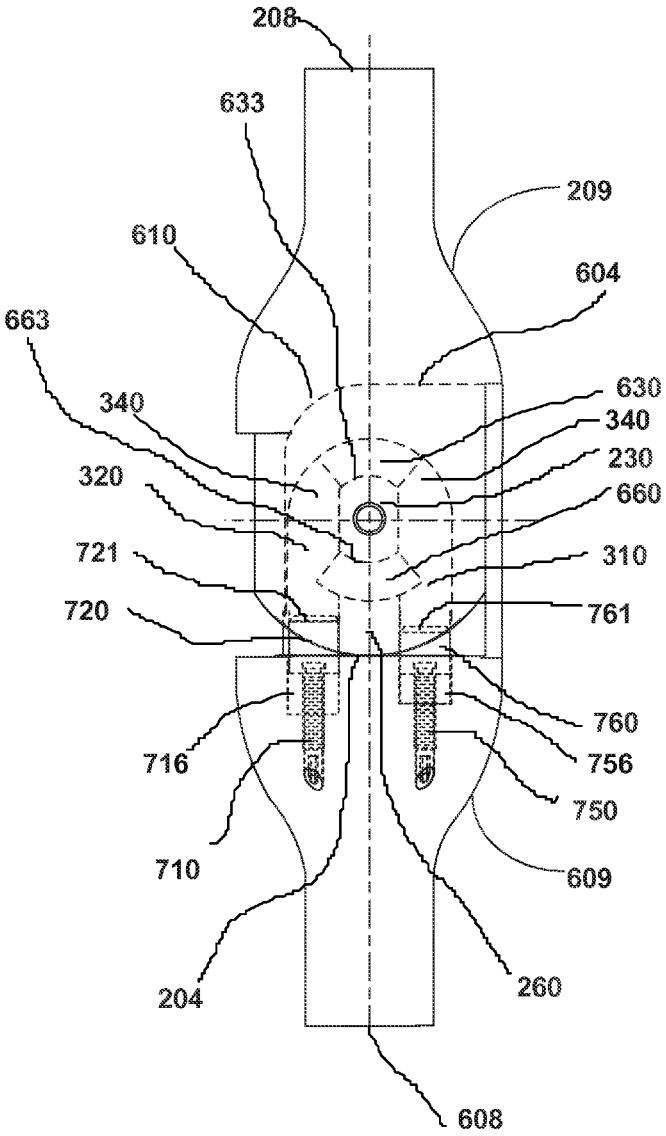
FIG. 25 is an enlarged (compared to FIG. 23) top view schematically showing the male and female connectors now nested together in a "locked state".
Figure 26:
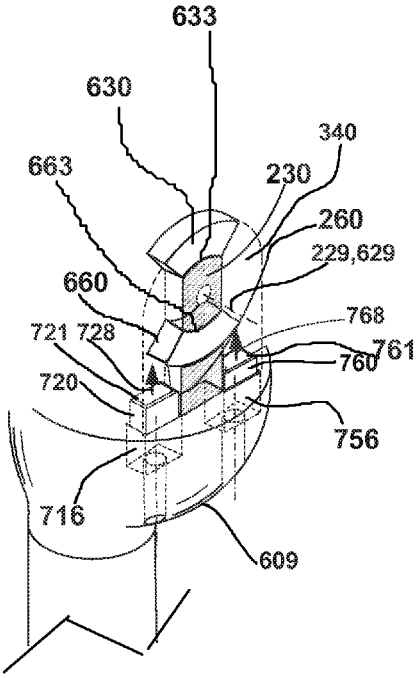
FIG. 26 is a partial cutaway view of the male and female connectors of FIG. 26 to better show the "locking operation" of the locking wedges/lugs of the male connector.

As shown in FIGS. 25 and 26, in one embodiment, when lower bail section 150 (including male connector 600) is parallel to upper bail section 100 (including female connector 200) locking wedge/lug 720 can be activated to at least partially extend out of receiving area 716 of male connector 600 and into track 320 of female connector (schematically indicated by arrow 728). Locking wedge/tab 720 now partially extending into track 320 and partially remaining in receiving area 716 will prevent relative rotation between male 600 and female 200 connectors causing upper bail section 100 and lower bail section to remain locked together by the interaction of their respective locking lugs as described above. Movement of locking wedge/tab 720 in the direction of arrow 728 (and in the opposite direction) can be controlled by rotation of threaded fastener 710 relative to male connector 600. In one embodiment extension and retraction of locking wedge/tab 720 can be remotely controlled.

In various embodiments a second locking wedge/tab 760 can be provided which is constructed substantially similar to locking wedge 720, but which can be received in receiving area 756 of male connector 600, and which is rotationally connected to threaded fastener 750. When lower bail section 150 (including male connector 600) is parallel to upper bail section 100 (including female connector 200) locking wedge 760 can be activated to at least partially extend out of receiving area 756 of male connector 600 and into track 310 of female connector (schematically indicated by arrow 768). Locking wedge/tab 760 now partially extending into track 310 and partially remaining in receiving area 756 will prevent relative rotation between male 600 and female 200 connectors causing upper bail section 100 and lower bail section to remain locked together by the interaction of their respective locking lugs as described above. Movement of locking wedge/tab 760 in the direction of arrow 768 (and in the opposite direction) can be controlled by rotation of threaded fastener 750 relative to male connector 600. In one embodiment extension and retraction of locking wedge/tab 760 can be remotely controlled.

Female Connector

Figures 10, 11, 12, 12A, 13, 14, 15, 16:
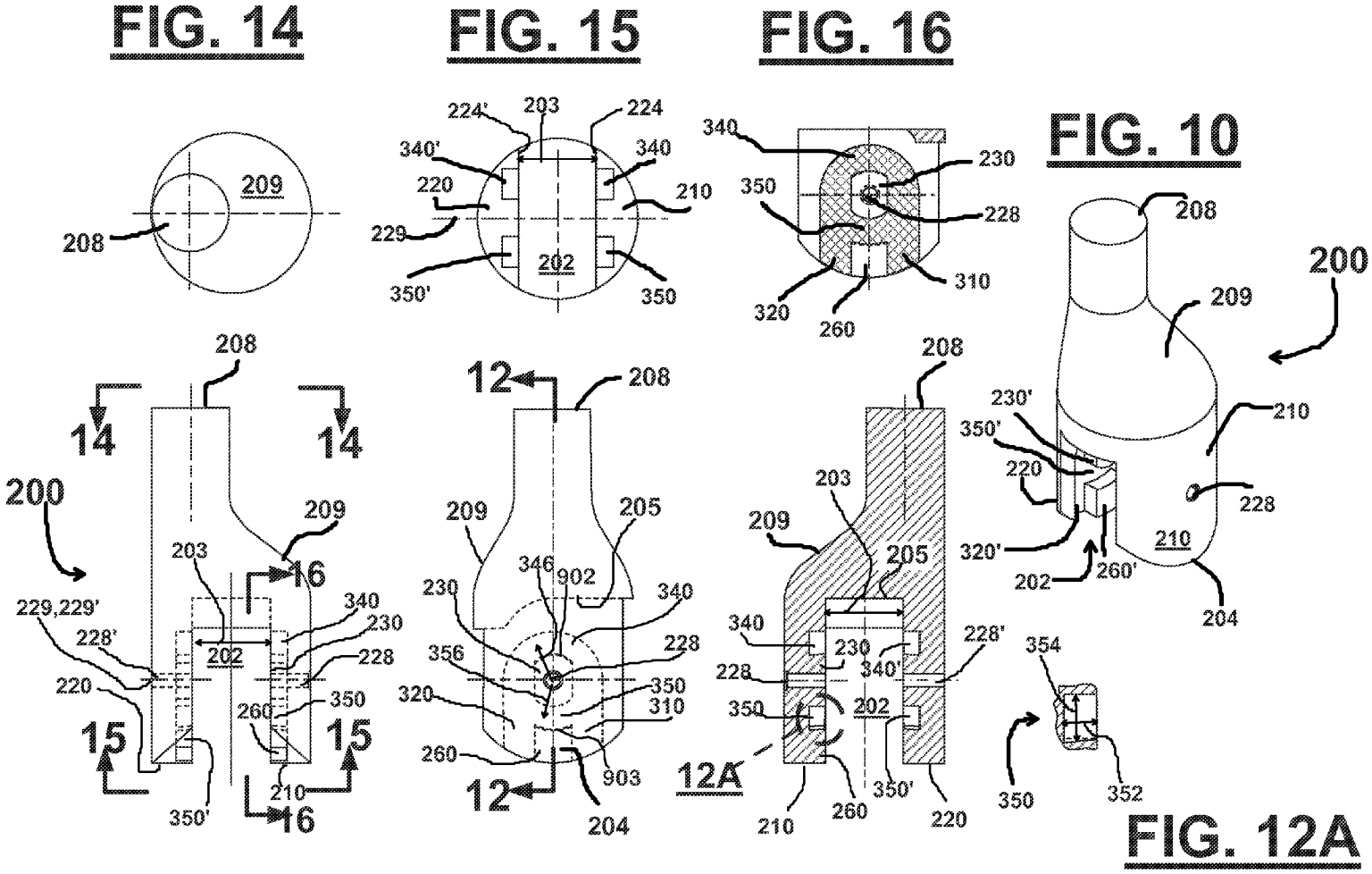
FIG. 10 is a perspective view of one embodiment of a female connector member.
FIG. 11 is a top view of the female connector member of FIG. 10.
FIG. 12 is a sectional view of the female connector member of FIG. 10 taken through lines 12-12 of FIG. 11.
FIG. 12A is an enlarged view from FIG. 12 of the cross track.
FIG. 13 is a side view of the female connector member of FIG. 10.
FIG. 14 is an end view of the female connector member of FIG. 10 taken from lines 14-14 of FIG. 13.
FIG. 15 is an end view of the female connector member of FIG. 10 taken from lines 15-15 of FIG. 13.
FIG. 16 is a partial sectional view of the female connector member of FIG. 10 taken through lines 16-16 of FIG. 13.

FIG. 10 is a perspective view of one embodiment of a female connector 200. FIG. 11 is a top view of the female connector 200. FIG. 12 is a sectional view of the female connector 200 taken through lines 12-12 of FIG. 11. FIG. 12A is an enlarged view from FIG. 12 of the cross track 350. FIG. 13 is a side view of the female connector 200. FIG. 14 is an end view of the female connector 200 taken from lines 14-14 of FIG. 13. FIG. 15 is an end view of the female connector 200 taken from lines 15-15 of FIG. 13. FIG. 16 is a partial sectional view of the female connector 200 taken through lines 16-16 of FIG. 13.

Lockable female connector portion 200 can include first end 204, second end 208, enlarged section 209, with first and second arms 210, 220 having an open receiving area/mouth 202 with a spacing or gap 203.

First/upper arm 210 can have substantially planar surface 224, first load bearing lug or flank 230, second load bearing lug or flank 260, and recessed tracks 310, 320, 340, and 350. Load bearing lug 230 may have load bearing surface 902, and load bearing lug 260 may have load bearing surface 903.

First recessed track opening 310 can have a width 314 and depth 312. Second recessed track opening 320 can have a width 324 and depth 322 substantially matching first track 310. Similarly, outer connecting track 340 can have width 344 and depth 342 substantially matching first 310 and second 320 tracks. Similarly, inner connecting track 350 can have width 354 and depth 352 substantially matching first 310 and second 320 tracks.

First lug 230 can have a bore hole 228 with longitudinal centerline 229, an inner radius of curvature 233 and outer radius of curvature 236.

Second lug 260 can have a radius of curvature 264.

Second/lower arm 220 can have substantially planar surface 224', first lug 230', second lug 260', and recessed tracks 310', 320', 340', and 350' all of which preferably follow the size and dimensions of first arm's 210" first lug 230, second lug 260, and recessed tracks 310, 320, 340, and 350. With the same construction of first 210 and second 220 arms, longitudinal axis 229' of bore 228' is coincident with longitudinal axis 229 of bore 228.

Connecting and Disconnecting Male and Female Connectors

Figure 18:
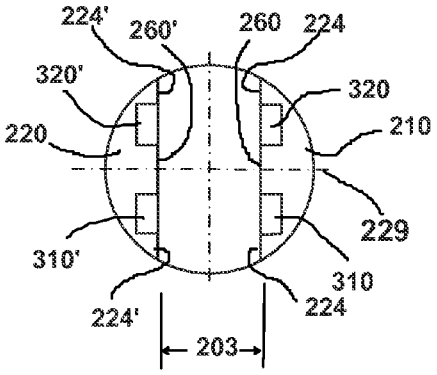
FIG. 18 is an end view of the female connector member of FIG. 17 taken from lines 18-18 of FIG. 17.
Figure 20:
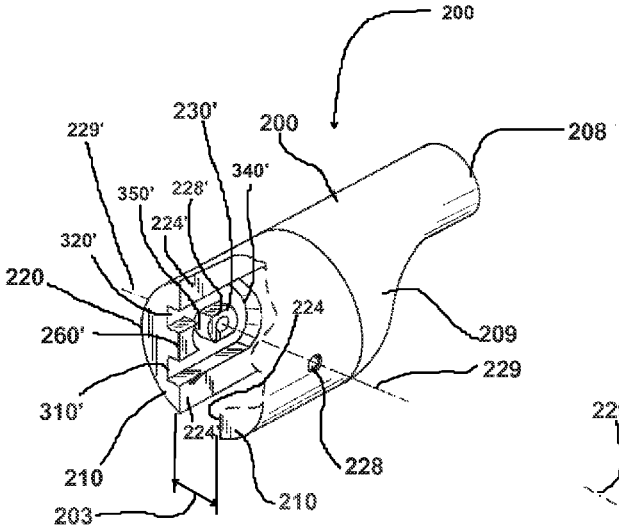
FIG. 20 is a perspective view of the female connector of FIG. 13 with one of the upper arms partially removed to better show the connecting track and lug systems for each of the upper and lower arms
Figure 19:
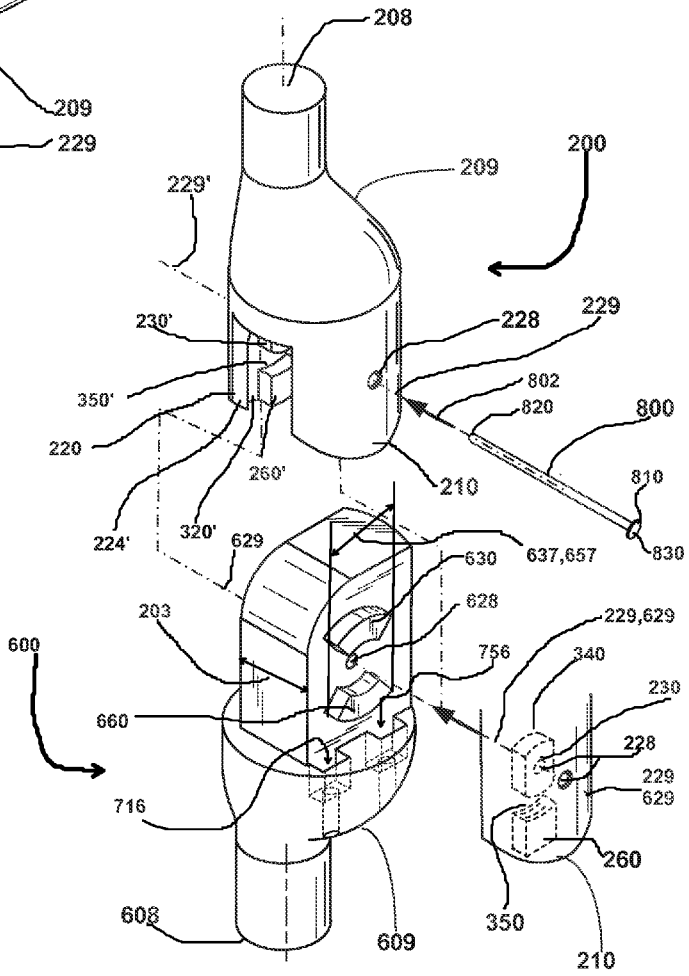
FIG. 19 includes perspective views of both the male and female connector of one embodiment shown parallel to each other.

FIG. 17 includes perspective views of both the male 600 and female 200 connectors of one embodiment shown ninety degrees relative to each other. FIG. 18 is an end view of the female connector 200 taken from lines 18-18 of FIG. 17. FIG. 19 includes perspective views of both the male 600 and female 600 connectors with their longitudinal axes (e.g., the axes of the link members attached to the connectors) shown parallel to each other. FIG. 20 is a perspective view of the female connector 200 with part of the upper arm 210 partially removed to better show the connecting track and lug systems of the lower arm 220 which is substantially the same as the connecting track and lug systems of the upper arm.

FIGS. 21 through 26 schematically show the process of "quick connect" and then rotationally locking the male 600 and female 200 connectors.

Figure 21:
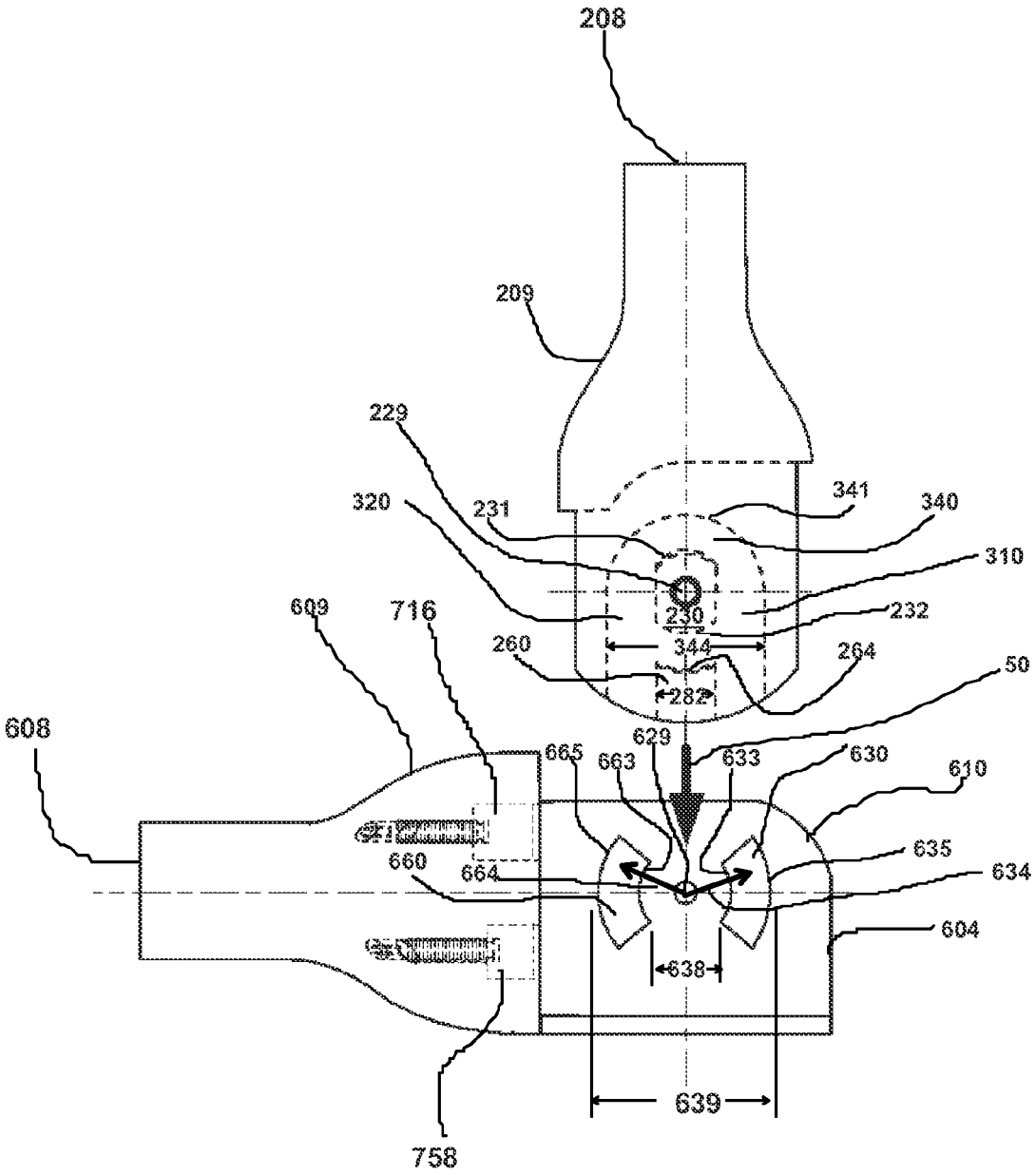
FIG. 21 is a top view schematically showing the male and female connectors being put together while the male and female connector are at ninety degrees relative to each other.

FIG. 21 is a top view schematically showing the male 600 and female 200 connectors being put together (schematically indicated by arrow 50) while the male 600 and female 200 connectors are at ninety degrees relative to each other.

In the direction of arrow 50 the male extension 620 of male connector 600 can enter mouth 202 of female connector 200. Here, lug 630 can enter track 310 and lug 660 can enter track 320 as the widths 314 and 324 are wide enough to accept their respective lugs 630,660. Also lug 630' can enter track 310' and lug 660' will enter track 320' as the widths 314' and 324' are wide enough to accept their respective lugs 630',660'.

Figure 22:
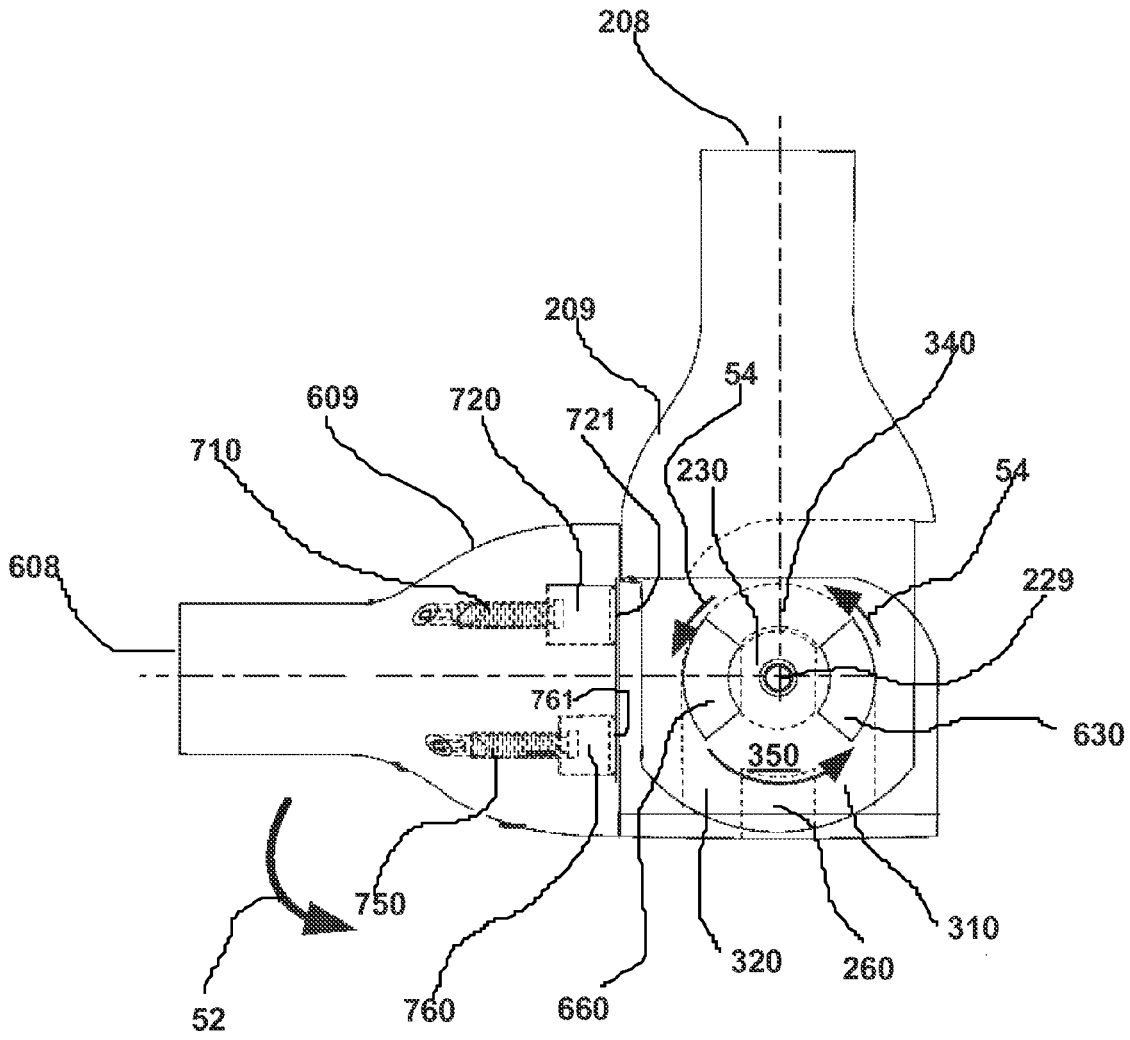
FIG. 22 is a top view schematically showing the male and female connectors now nested together in an "unlocked state" while the male and female connector are at ninety degrees relative to each other, and schematically indicating that the male and female connectors can be locked relative to each other by relative rotational movement between the two connectors.

FIG. 22 is a top view schematically showing the male 600 and female 200 connectors now nested together in an "unlocked state" while the male 600 and female 200 connectors are at ninety degrees relative to each other, and schematically indicating that the male 600 and female 200 connectors can be locked relative to each other by relative rotational movement between the two connectors (schematically indicated by arrows 54). Arrow 52 schematically indicates that male connector 600 is moved relative to female connector 200.

Figure 23:
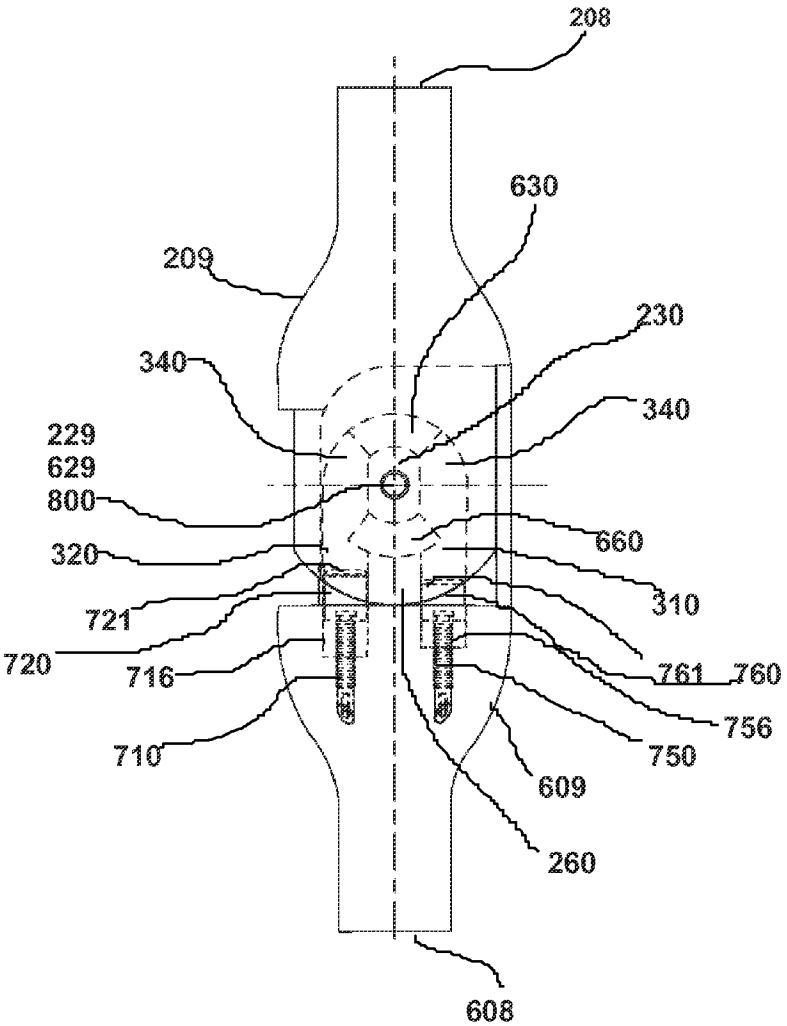
FIG. 23 is a top view schematically showing the male and female connectors now nested together in a "locked state" while the male and female connectors are parallel to each other (being rotated ninety degrees relative to each from their positions shown in FIG. 22), and also showing the locking wedges/lugs of the male connector being in an extended state to prevent relative rotation between the male and female connectors.

From the longitudinally unlocked relative perpendicular or 90 degree orientation shown in FIG. 22 to the longitudinally locked parallel position shown in FIG. 23. Relative rotation between male connector 600 and female connector 200 is allowed by lug 630 entering outer connecting track 340, and lug 660 entering inner connecting track 350. Similarly, on the other side of male connector 600 lug 630' enters outer connecting track 340', and lug 660' enters inner connecting track 350'. The spacing and radii of curvature of these load bearing lugs and tracks are constructed to allow said mating and relative rotation.

Figure 24:
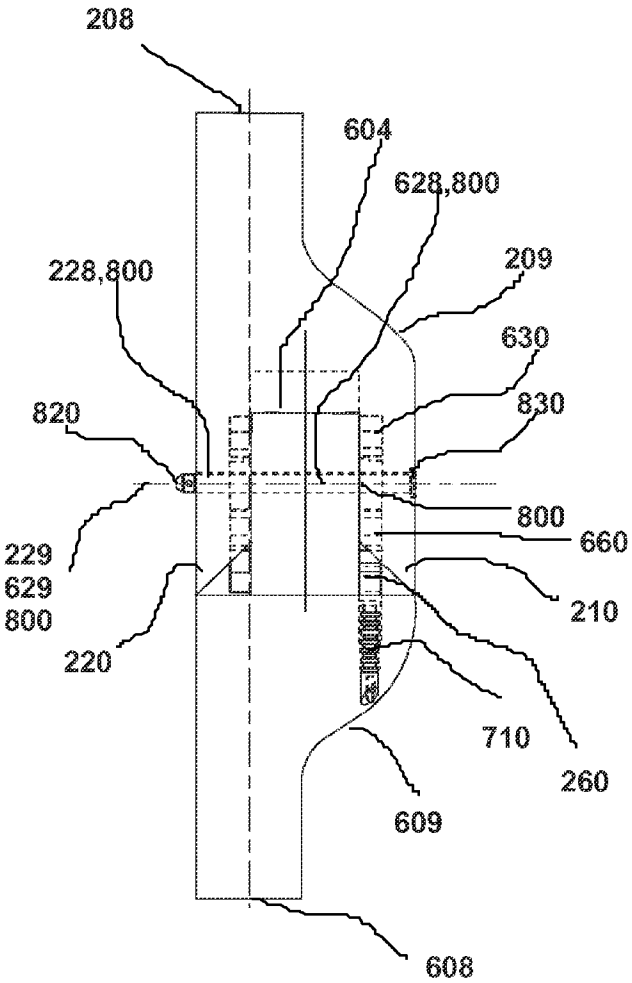
FIG. 24 is a side view of the "locked" male and female connectors shown in FIG. 23.

FIG. 23 is a top view schematically showing the male 600 and female 200 connectors now nested together in a longitudinally "locked state" while the male 600 and female 200 connectors are parallel to each other (being rotated ninety degrees relative to each from their positions shown in FIG. 22), and also showing the locking wedges/lugs 720 and 760 of the male connector 600 being in a partially extended state to "rotationally lock" and prevent relative rotation between the male 600 and female 200 connectors so that the connectors remain in the longitudinally "locked state". FIG. 24 is a side view of the longitudinally and rotationally "locked" male 600 and female 200 connectors shown in FIG. 23.

Male connector 600 is longitudinally locked to female connector by the nesting of lugs 630 and 660 of male connector 600 with lugs 230 and 260 of arm 210 of female connector 200 (and similarly the nesting of lugs 630' and 660' with lugs 230' and 260' of arm 220 of female connector 200).

In the longitudinally locked state the male 600 and female 200 connectors can absorb longitudinal loads, and in such longitudinally locked position can be used for connection purposes even if not "rotationally locked" relative to each other. However there is the risk that, when not "rotationally locked, loading on the male 600 and female 200 connectors will cause them to be rotated to an unlocked position during use so it is preferred to "rotationally" lock the male 600 and female 200 connectors before use as a safety precaution.

FIG. 25 is an enlarged (compared to FIG. 23) top view schematically showing the male 600 and female 200 connectors now nested together in both a longitudinally and rotationally "locked state". FIG. 26 is a partial cutaway view of the male 600 and female 200 connectors to better show the rotational "locking operation" of the locking wedges/lugs 720,760 of the male connector 600. Locking wedges/lugs 720,760 "rotationally lock" male 600 and female 200 connectors by respectively occupying simultaneously in both track 320 and receiving portion 716 (wedge/lug 720) and track 310 and receiving portion 756 (wedge/lug 760).

Female 200 and male 600 connectors may include a rotation torque stop, such as when first end 604 of male connector 600 comes into contact with base 205 of mouth 203 of female connector 200 (and also possibly planar wall 612 of male connector 600 coming into contact with first end 204 of female connector 200) limiting the total amount of relative rotation between the two connectors.

In various embodiments, the detachable connection of between upper 100 and lower (e.g., 120 or 150) bail sections can be accomplished by various methods. In the preferred method as depicted in FIGS. 27-34, an upper bail section 100 can remain connected/attached to the traveling block or top drive 11, via a connection to a link tilt system 30 while a selected lower bail section (e.g., lower bail section 150) is being attached to upper bail section 100 as shown in FIGS. 31 through 34.

Figure 37:
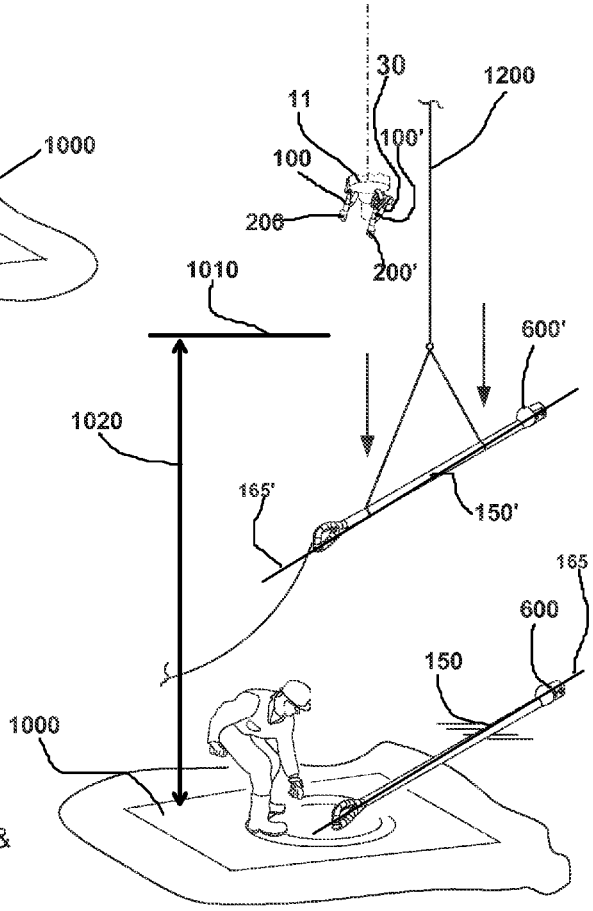
FIG. 37 schematically shows the bail link system of FIG. 34 again being changed from the bail links of second length and second capacity.

As shown in FIG. 37 an appropriate lower bail section 150 can be selected from a set of possible lower bail sections having multiple lengths and/or capacities based on the rig operation to be performed. The lower bail section 150 can be connected to upper bail section 100 by presenting its longitudinal axis 165 in a nonparallel orientation relative to the longitudinal axis 115 of upper bail section 100.

To connect the two bail portions, male connector 600 of lower bail portion 150 can be moved upwardly into female connector 200 (schematically indicated by arrow 70 in FIG. 31) of upper bail portion 100 while maintaining a particular relative angular relation (schematically indicated by relative angle 190 in FIG. 28) between the longitudinal 165 axis of lower bail portion 150 compared to the longitudinal axe 115 of upper bail portion 100, and until male connector 600 is slid into female connector 200 thereby aligning rotational axes 229 and 629 positioning pin holes 228 and 628 of the two bail sections 100, 150. At this point a rotational rod 800 can be slid into bore hole 228 of first arm 210 of female connector 200, through bore hole 628 of male connector 600, and finally through bore hole 228' of second arm 220 of female connector 200 (see FIGS. 32 and 33).

In various embodiments, rotational rod 800 may be secured within the bore holes. In various embodiments, rotational rod 800 may comprise a threaded pin secured by a threaded nut and internal tooth locking washer (with secondary retention via cotter key through predrilled hole in the pin). Rotational rod 800 may also comprise a threaded pin secured by threaded nut and external tooth locking washer (with secondary retention via cotter key through predrilled hole in the pin). In various embodiments rotational rod 800 may be a threaded pin secured by threaded nut and helical spring locking washer (secondary retention via cotter key through predrilled hole in the pin). In various embodiments, rotational rod 800 may comprise a threaded pin secured by threaded nut and wave locking washer (secondary retention via cotter key through predrilled hole in the pin). In various embodiments, rotational rod 800 may be a threaded pin secured by threaded nut and Belleville spring locking washer (secondary retention via cotter key through predrilled hole in the pin).

Figures 31, 32:
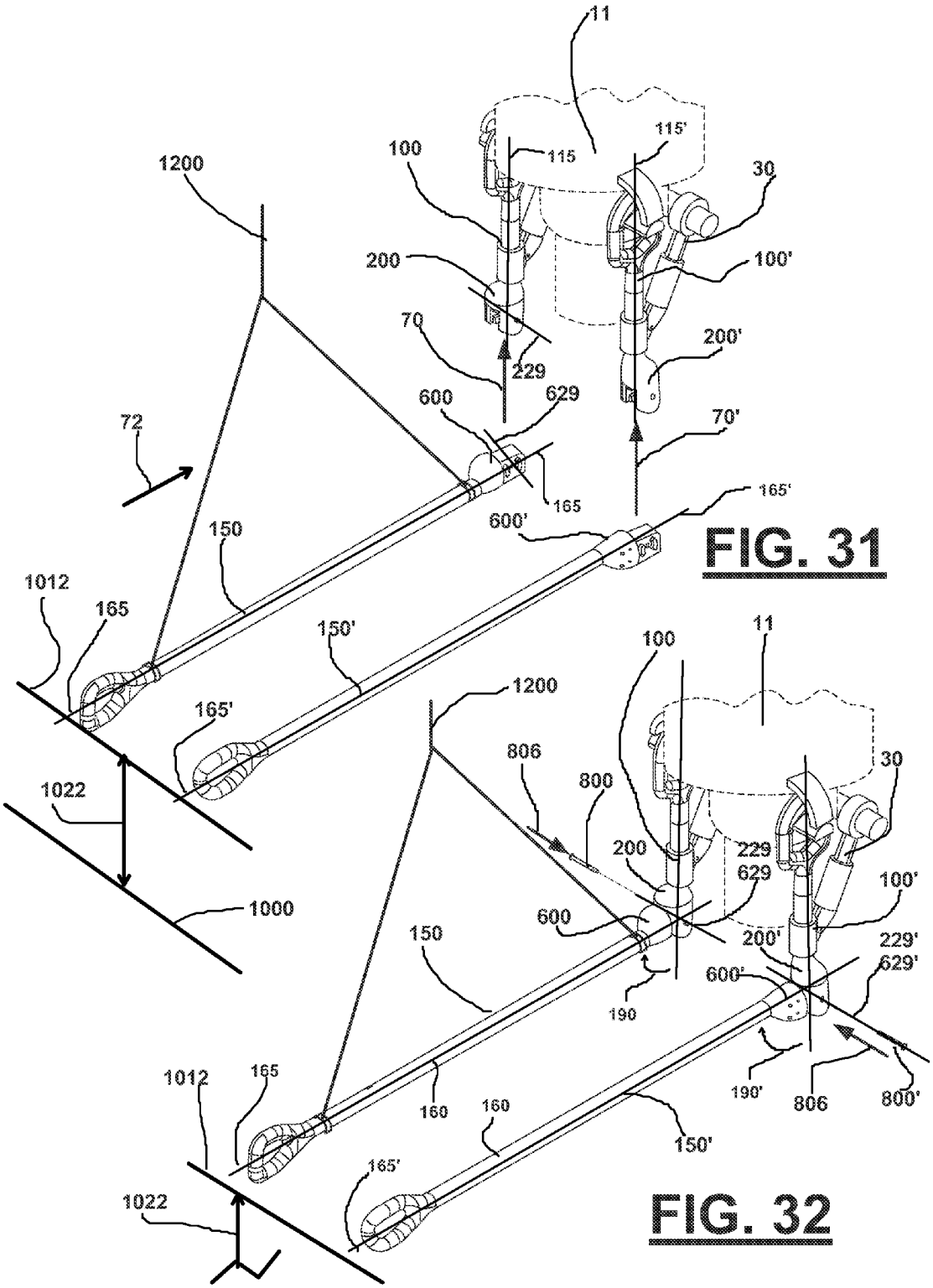
FIG. 31 schematically shows the male and female connectors being reassembled (now with the male connectors having second links of a second length and second capacity which are not equal to the first links of first length and first capacity) by the connectors being moved in a direction parallel to the longitudinal axis of one of the connectors (e.g., female connector) and perpendicular to the longitudinal axis of the other of the connectors (e.g. male connector).
FIG. 32 schematically shows the rotational shafts being inserted into each of the two sets of male and female connectors of FIG. 31, which rotational shafts will facilitate the male and female connectors to being rotated relative to each other.

As shown in FIG. 31, in connecting upper and lower bail sections 100, 150, the longitudinal axis 165 of lower bail section 150 will be positioned in nonparallel orientation relative to the longitudinal axis 110 of upper bail portion 100, and lower bail section 150 will be moved in the direction of arrow 70.

Figures 33, 34:
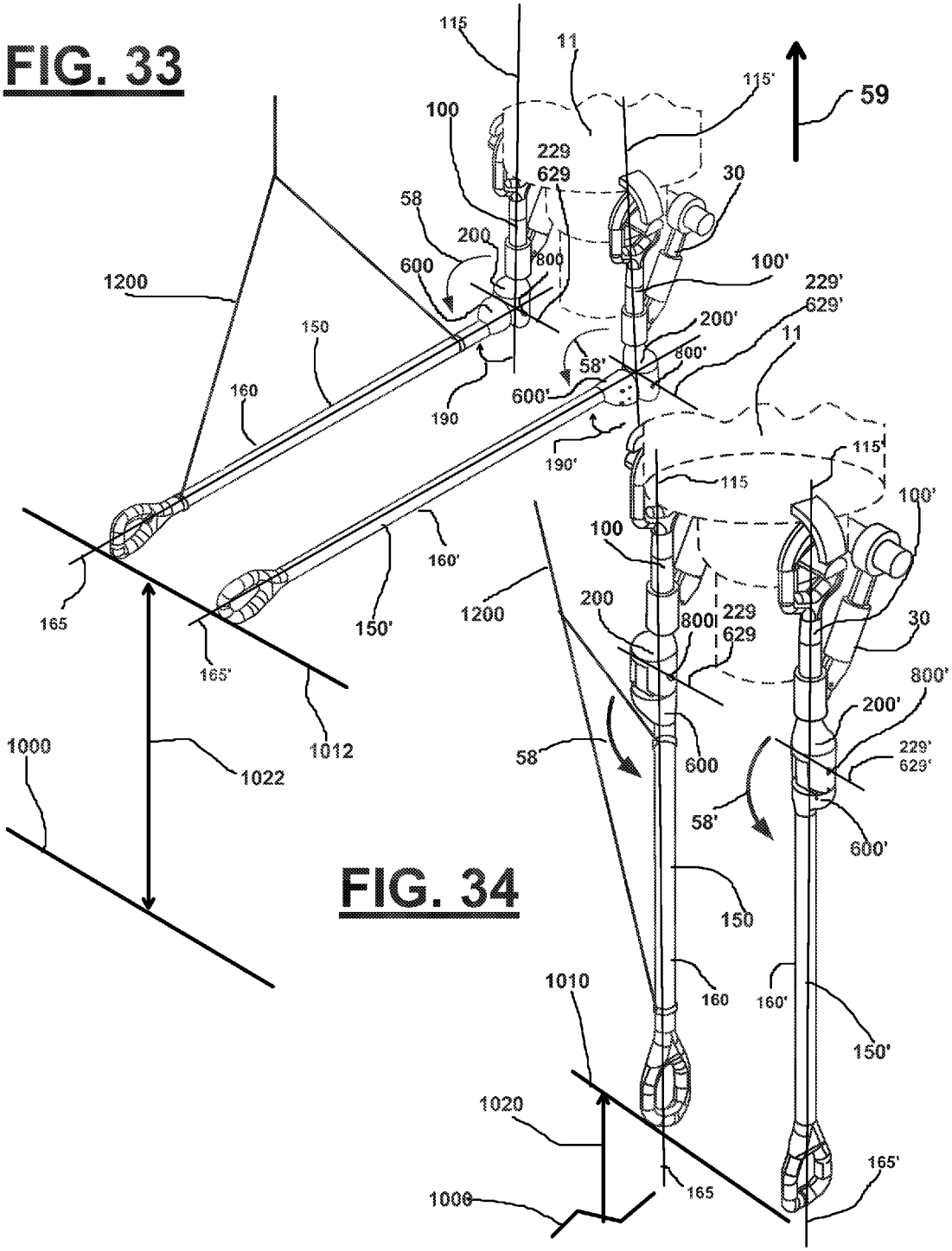
FIG. 33 schematically shows the rotational shafts now inserted into each of the two sets of male and female connectors of FIG. 31.
FIG. 34 schematically shows the male and female connectors being placed in a locked state (now with the male connectors having second links of a second length and second capacity which are not equal to the first links of first length and first capacity) by the connectors being rotated relative to each other about an axis which is perpendicular to the longitudinal axis of one of the connectors (e.g., female connector), and optionally allowing this locked state to be maintained by placing the locking wedges/lugs in an extended state, and where the lowest point of the bail links were maintained spaced above the rig floor at least a predefined amount during the assembly process.

As shown in FIG. 32 lower bail portion 150 will then be moved up in the direction of arrow 70 to align bore holes 228, 628, and 228'. FIG. 32 shows bore holes 228,628, and 228' aligned with each other and with the longitudinal axes 115 and 165 in a non-parallel orientation. The positioning pin 800 can then be installed, and the traveling block or top drive 11 is raised (schematically indicated by arrow 59 in FIG. 33) until the lower bail section 150 has been rotated to a vertical or parallel orientation in relation to the upper bail section 100 (in the parallel orientation longitudinal axes 110,165 are parallel to each other). When the traveling block or top drive 11 is raised, the lower bail section 150 will rotate in the direction of arrow 58 until it is in vertical or parallel alignment with the upper bail portion 100, as seen in FIG. 34.

In the illustrated embodiments shown, the splines/male support lugs 630,630',660,660' of male connector 600 and splines/support lugs 230,230',260,260' of the female connector 200 in the upper 100 and lower (e.g., 120 or 150) bail portions of the rotatable female 200 and male 600 connectors intermesh and serve to transfer the load carrying capability from the upper bail section 100 to the lower bail section (e.g., 120 or 150) and subsequently to the elevator 13 and tubular string 20 (see FIG. 36). During the rotation of the lower bail section 150 the male support lugs 630,630', 660,660' of male connector 600 and support lugs 230,230', 260,260' of the female connector 200 mesh and align themselves to create the load transfer mechanism from upper bail section 100 to lower bail section 150.

Relative rotation can be arrested at the true vertical position (shown in FIG. 34) by a rotational torque stop, such as when first end 604 of male connector 600 comes into contact with base 205 of mouth 203 of female connector 200 (and also possibly planar wall 612 of male connector 600 coming into contact with first end 204 of female connector 200) limiting the total amount of relative rotation between the two connectors. In this way rotation of lower bail section 150 (or 120) in the direction of arrow 58 relative to upper bail section 100 about rod 800 causes female 200 and male 600 connectors to engage and be stopped from further rotation when aligned vertically.

In one embodiment, when lower bail section (e.g., 120 or 150) can rotate in the direction of arrow 58, the pin sets 200, 210, 220, and 230 (schematically shown in FIG. 34) respectively engage female groove, slot or recess sets 100,110,120, and 130. In this embodiment female groove, slot or recess sets 100 and 110 point in the opposite direction compared to female groove, slot or recess sets 120 and 130.

In various embodiments the splines/male support lugs 630,630',660,660' of male connector 600 and splines/support lugs 230,230',260,260' of the female connector 200 may be helical or arched to facilitate proper engagement while rotating into position. In addition the splines/support lugs 230,230',260,260' may be tapered to facilitate flexible initial alignment and also result in a closer fit as the bail sections are rotated into vertical position. In a preferred embodiment the splines/female lugs 230,230',260,260' may be tapered along load carrying portions 902, 902', 903, 903' at a 3 degree angle with a dovetail design. In additional embodiments, angling of the load carrying portions 902, 902', 903, 903' of the lugs 230,230',260,260' may be at 1, 2, 3, 4, 5, 6, 7, 8, 9, 10, 11, 12, 13, 14, 15, 16, 17, 18, 19, 20, 22, 24, 26, 28, and 30 degrees. In some embodiments, the load carrying portion of the lugs 230,230',260,260' may be 90 degrees relative to the surface of outer and/or inner tracks respectively, without tapering. In other embodiments, any suitable angle of tapering along load carrying portions of the lugs 230,230',260,260' may be utilized. In other embodiments, lugs 230,230',260,260' may be tapered from end to end at any suitable angle.

The splines/male support lugs 630,630',660,660' of male connector 600 and splines/support lugs 230,230',260,260' of the female connector 200 preferably incorporate a dovetail design on the (top) load carrying surfaces 900, 900', 901, 901' 902, 902', 903, 903' (e.g., the load carrying surfaces tapered from a 90 degree angle relative to flat surfaces 624 and 224, or not making a 90 degree angle relative to said flat surfaces) to further enhance load carrying capability and decrease spreading forces in the female 200 and male 600 connectors. In other various embodiments, the splines/male support lugs 630,630',660,660' of male connector 600 and splines/support lugs 230,230',260,260' of the female connector 200 may be tapered from their bases to their tops (e.g., form one end to the other). In various embodiments the splines/male support lugs 630,630',660,660' of male connector 600 and splines/support lugs 230,230',260,260' of the female connector 200 may be tapered or angled at 1, 2, 3, 4, 5, 6, 7, 8, 9, 10, 11, 12, 13, 14, 15, 16, 17, 18, 19, 20, 22, 24, 26, 28, and/or 30 tapered degrees (e.g., the angles said load bearing surfacing being relative to flat surfaces 624 and 224 being offset from a 90 degree by the specified degree amount). In various embodiments the amount of taper and/or angle can be within a range of between any two of the above referenced specified amount of tapered/angled degrees. In various embodiments, the load carrying faces/sides of the female lugs 230,230',260,260' (e.g., sides 902 and 903) may be without tapering or angling (i.e., making a 90 degree angle with flat surfaces 624 and 224). In other embodiments, any suitable angle of tapering along load carrying portions of the lugs 230,230',260,260' can be utilized. In other embodiments, lugs 230,230',260,260' may be tapered end to end at any suitable angle.

In the illustrated method, the splines/male support lugs 630,630',660,660' of male connector 600 and splines/support lugs 230,230',260,260' of the female connector 200 in the upper 100 and lower (e.g., 120 or 150) bail portions of the rotatable female 200 and male 600 connectors intermesh and serve to transfer the load carrying capability from the upper bail section 100 to the lower bail section (e.g., 120 or 150) and subsequently to the elevator 13 and tubular string 20. The splines/male support lugs may be helical or arched to facilitate proper engagement while rotating into position. In addition, in a preferred embodiment, the splines/male support lugs may be tapered in a dovetail design to facilitate flexible initial alignment and also result in a closer fit as the bail sections are rotated into vertical position. In a preferred embodiment the splines/male lugs 630,630',660,660' may be tapered in a dovetail design along load carrying portions 900, 900', 901, 901' at a 3 degree angle. In additional embodiments, angling of the load carrying portions of the lugs 630,630',660,660' may be at angle 1, 2, 3, 4, 5, 6, 7, 8, 9, 10, 11, 12, 13, 14, 15, 16, 17, 18, 19, 20, 22, 24, 26, 28, and 30 degrees (or the amount of taper and/or angle can be within a range of between any two of the above referenced specified amount of tapered/angled degrees). In some embodiments, the load carrying portion of the lugs 630,630', 660,660' may be 90 degrees relative to surface 624, without tapering. In other embodiments, any suitable angle of tapering along load carrying portions of the lugs 630,630',660, 660' may be utilized. In other embodiments, lugs 630,630', 660,660' may be tapered from end to end at any suitable angle.

Alternatively, the upper 100 and lower (e.g., 120 or 150) bail sections could be mated directly to each other in the vertical position, with either a splined connector or with splines incorporated directly into the upper and lower bail sections.

Alternatively, the upper 100 and lower (e.g., 120 or 150) bail sections could be mated with a spaced spline connector that comprises a female splined connector and a male splined connector, which is mated lengthwise and then rotated into position so that splines are engaged and then carry the necessary load.

Alternatively, the upper 100 and lower (e.g., 120 or 150) bail sections could be mated with a splined, and/or clamped connection engaged by various means, either manual, automatic or remotely activated.

Alternatively, the upper 100 and lower (e.g., 120 or 150) bail sections could be mated with a ball and recess system similar to a pneumatic or hydraulic quick connect.

Alternatively the upper 100 and lower (e.g., 120 or 150) bail sections could be mated with a grapple type system, similar to a fishing tool.

General Method of Disconnecting and Connecting

FIGS. 27 through 34 show one embodiment of a method and apparatus for interchangeable bail links, depicting a method of detaching a lower bail portion 120 and replacing it 120 with an alternative lower bail section 150'. During this entire process upper bail section 100 can remain connected to tilt link system 30 (as schematically indicated in the Figures). In various embodiments, an eyelet or loop portion 14 of upper bail 100 may remain connected to link tilt system 30 of a top drive or traveling block 11 while interchanging lower bail sections. In various embodiments an eyelet or loop portion 14 of upper bail 100 has a connection for a top drive or traveling block and the upper bail also has a connection for a link/tilt system.

As an example, the drilling rig may be outfitted with a 500 Ton (453,592 Kilogram) top drive, the drill string may only require 350 Ton (317,514 Kilogram) capacity, while 500 Ton (453,592 Kilogram) capacity is required for running casing. In this case the upper bail section 100 may be approximately 5 feet (1.5 Meters) long, 500 Ton (453,592 Kilogram)

capacity, and include the section 100 where the link tilt is system 30 is connected. The first lower section 120, while drilling and tripping, may be 4 feet (1.2 Meters) long and 350 Ton (317,514 Kilogram) capacity, yielding an overall length of 9 feet (2.7 Meters) and 350 Ton (317,514 Kilogram) capacity during drilling operations. When time to run casing, the 4 foot (1.2 Meter) 350 Ton (317,514 Kilogram) lower section 120 could then be removed, and replaced with a second 13 foot (4.0 Meter) 500 Ton (453,592 Kilogram) lower section 150, yielding an overall length of 18 feet (5.5 Meters) and a 500 Tons (453,592 Kilogram) capacity. In addition, the link tilt system 30 can remain attached to the upper bail section 100 during the connect or disconnect process and available for use if needed.

Disconnection Example

FIGS. 27 through 30 schematically depict the process of detaching lower bail section 120 from upper bail section 100.

Figure 27:
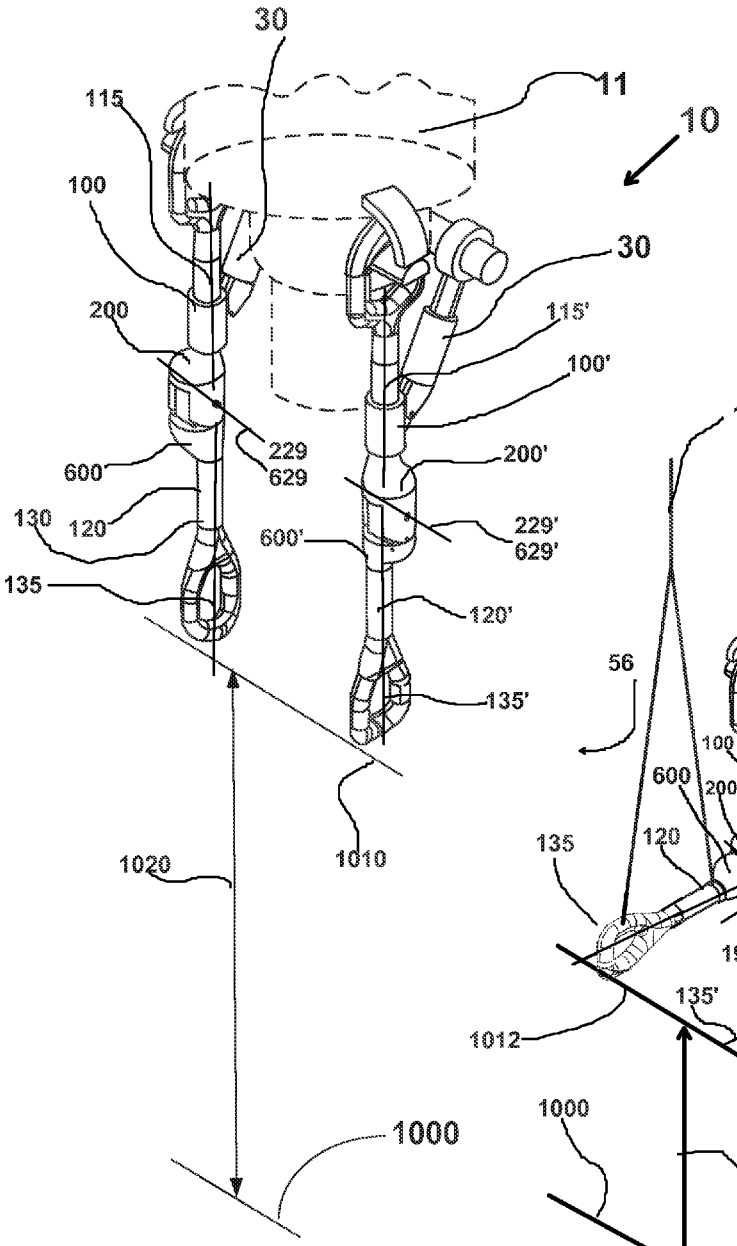
FIG. 27 is a perspective view of two sets of male and female connectors shown in a locked state (e.g., at being least parallel to each other, and optionally including locking wedges/lugs in an extended state), and where each of the male connectors has a first bail link of a first size and capacity, and where the lowest point of the bail links are spaced above the rig floor at least a predefined amount.

FIG. 27 is a perspective view of two sets of male 600,600' and female 200,200' connectors shown in a locked state (e.g., with the longitudinal axes of the upper and lower bails being parallel to each other, and optionally including locking wedges/lugs in an extended state), and where each of the male connectors 600,600 has a first bail link of a first size and capacity (respectively 120 and 120'), and where the lowest point of the bail links 120 and 120' are spaced above the rig floor 1000 at least a predefined amount (schematically indicated by dimension 1020 to line 1010).

Figure 28:
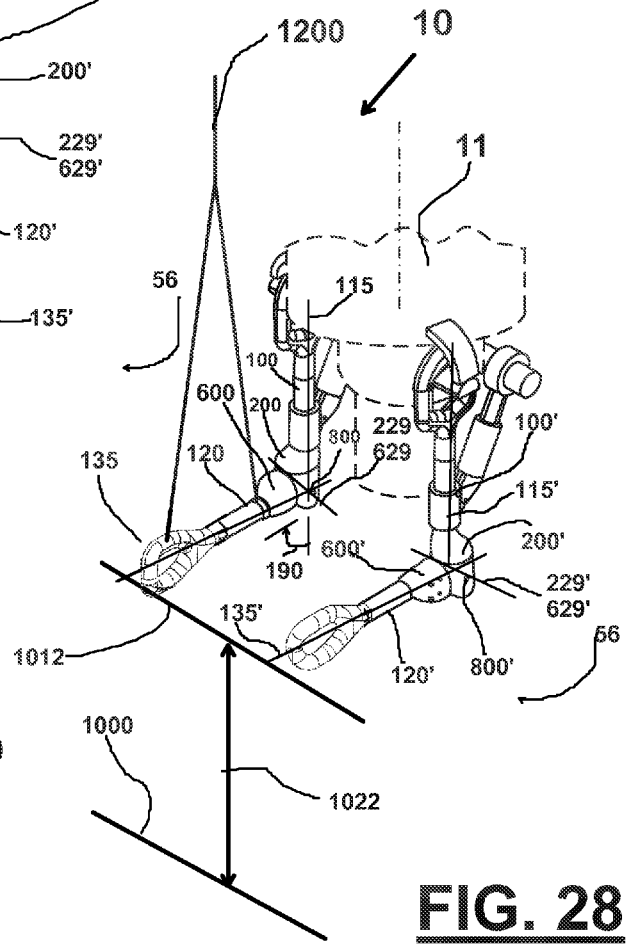
FIG. 28 is a perspective view of the two sets of male and female connectors of FIG. 27 where the locking wedges/lugs of the male connected have been retracted and the connectors are subsequently put in an unlocked state by rotation relative to each other (e.g., rotated 90 degrees relative to each other about an axis which is perpendicular to the longitudinal axis of at least one of the connectors) and showing the bail link being supported by a hoist.

FIG. 28 is a perspective view of the two sets of male 600,600' and female 200,200' connectors where the locking wedges/lugs 720/720' and 760/760' of the male connectors 600,600' have been retracted and the connectors are subsequently put in an unlocked state by rotation relative to each other about an axis which is perpendicular to the longitudinal axis of at least one of the connectors (respectively rotated 90 degrees relative to each other about axes 229/629,229'/629') and showing one of the lower bail links 120 being supported by a hoist 1200. For its disconnection process the second bail link 120' would also be supported by a hoist (e.g., 1200 or a second hoist 1200'), but this hoist is not shown for purpose of clarity in the drawings. Alternatively, both lower bail sections 120, 120' may be supported by a single hoist or cradle for disconnection of both bails 120, 120' at the same time, for enabling additional time saving benefits. In various embodiments a cradle or hoist may support both lower arms and also an elevator.

FIG. 29 schematically shows the rotational shafts 800 and 800' being removed from each of the two sets of male and female connectors, which removal now allows for the male and female connectors to be separated (respectively male connection 600 separated from female connector 200 and male connector 600' separated from female connector 200').

FIG. 30 schematically shows respectively male 600,600' and female 200,200' connectors being separated by the connectors being moved in directions parallel to respective longitudinal axis (e.g., axes 115 and 115') of one of the connectors (e.g., female connectors 200 and 200') and also perpendicular to the longitudinal axes (e.g., axes 135 and 135') of the other of the connectors (e.g. male connectors 600 and 600'), which movements are schematically indicated by arrows 60 and 60'.

The disconnection of first lower bail link portion 120 from upper bail link portion 100 will now be described in more detail. However, the steps described for disconnecting bail link portion 120 can similarly be used for disconnecting lower bail link portion 120' from upper bail link portion 100'.

If not already installed, rotational rod 800 can be slid into bore hole 228 of first arm 210 of female connector 200, through bore hole 628 of male connector 600, and finally through bore hole 228' of second arm 220 of female connector 200.

To rotationally unlock female 200 and male connectors 600, locking wedges/lugs 720 and 760 can be retracted respective into receiving areas 716 and 756.

As schematically shown in FIGS. 27 through 29, lower bail portion 120 can be rotated in the direction of arrow 56 to cause longitudinal axes 115 and 135 to change from a parallel to non-parallel or skewed orientation relative to each other.

Rod 800 can then be removed from upper and lower bail sections 100,120 either before or after their relative rotation. Relative rotation between upper and lower bail sections 100,120 can be caused by lowering traveling block or top drive 11 to cause the lower bail section 120 to rotate in the direction of arrow 56 and until it is in skewed or non-parallel alignment with the upper bail portion 100, as seen in FIG. 28. A hoist 1200 may be used to rotate the lower bail section 120 (schematically indicated by arrow 56 in FIGS. 28 and 29) at least a predetermined relative rotational amount (e.g. 90 degrees), to a disconnection position in relation to the upper bail portion 100, which can be the horizontal or nonparallel position shown in the figures.

Lower bail section 120 can be, for example, a drilling bail extension with a 350 ton (317,514 Kilogram) capacity and 4 feet (1.2 Meters) long. Rod 800 can be removed and lower bail portion 120 can then be detached from upper bail section by using hoist 1200 to both support and lower it in the direction of arrow 60, after which lower bail section 120 can be lowered to the rig floor 1000, and then be removed from the rig floor.

Lower bail section 120 can be moved relative to upper bail section 100 in the direction of arrow 60 to disconnect lower bail section 120 from upper bail section 100 and move lower bail section 120 away from upper bail section 100.

A new lower bail link section can now be connected to upper bail link section 100.

Connection Example

FIGS. 31 through 34 schematically depict the process of attaching alternatively selected lower bail sections 150 and 150' respectively to upper bail sections 100 and 100'. These steps are essentially done in the reverse order as the disconnecting of lower bail section 120 to upper bail section 100 as described above.

FIG. 31 schematically shows two sets of male 600,600' and female 200,200' connectors being reassembled (now with the male connectors 600,600' having second lower bail sections 150,150' of a second length and second capacity which are not equal to the first lower bail sections 120 and 120' of first length and first capacity) by the male connectors 600,600' being moved in a direction parallel to the longitudinal axis (e.g., axes 115 and 115') of one of the connectors (e.g., female connectors 200 and 200') and perpendicular to the longitudinal axis (e.g., axes 165 and 165') of the other of the connectors (e.g. male connectors 600 and 600'), which movements are schematically indicated by arrows 70 and 70'.

FIG. 32 schematically shows the rotational shafts 800 and 800' being inserted into each of the two sets of male 600,600' and female 200,200' connectors, which rotational shafts 800 and 800' facilitates the respective sets of male 600,600' and female 200,200' connectors being rotated relative to each other.

FIG. 33 schematically shows the rotational shafts 800 and 800' now inserted into each of the two sets of male 600,600' and female 200,200' connectors.

FIG. 34 schematically shows the male 600,600' and female 200,200' connectors being placed in a locked state (now with the male connectors 600 and 600' having second lower bail link members 150 and 150' of a second length and second capacity which are not equal to the first lower bail link members 120 and 120' of first length and first capacity) by the male 600,600' and female 200,200' connectors being rotated relative to each other about an axis which is perpendicular to the longitudinal axis of at least one of the connectors (respectively rotated 90 degrees relative to each other about axes 229/629,229'/629') and showing one of the lower bail links 150 being supported by a hoist 1200. For its connection process the second replacement bail link 150' would also be supported by a hoist (e.g., 1200 or a second hoist 1200'), but this hoist is not shown for purpose of clarity in the drawings. Alternatively, both lower bails 150 and 150' may be supported by a single hoist or cradle for connection of both bails 150 and 150' at the same time, for enabling additional time saving benefits. In various embodiments a cradle or hoist may support both lower bails and also an elevator.

Also it is noted that there is the option of rotationally locking the male 600,600' and female 200,200' in the parallel positions by placing their respective locking wedges/lugs in an extended state. It is also noted that during the connection process the lowest points of the lower bail links 150 and 150' may be maintained spaced above the rig floor 1000 at least a predefined amount during the assembly process (which is schematically indicated by dimension 1020).

An alternative lower bail portion 120 of a different length, configuration and/or tonnage capacity, may now be attached or connected to the upper bail section 100 as schematically shown in FIGS. 31 through 34.

FIG. 31 depicts upper bail portion 100 still connected to a link tilt mechanism 30 of a top drive 11, with an alternatively selected lower bail portion 150 which will be detachably connected to the upper bail portion 100. The alternative lower bail portion 150 may, for example, be a 500 Ton (453,592 Kilogram) capacity that is 14 feet (4.3 Meters) long.

The longitudinal axis 165 of alternative lower bail portion 150 can be positioned in a nonparallel relation to the longitudinal axis 115 of upper bail portion 100, while upper bail section 100 remains attached to the link tilt mechanism 30. Alternative lower bail portion 150 can be moved in the direction of arrow 72 towards upper bail section 100. Alternative lower bail portion/section 70 can be raised upward in the direction of arrow 70, as shown in FIGS. 31 and 32 until the bore holes 228, 628, and 228' align and rod 800 may be inserted through the bore holes 228, 628, and 228'. The traveling block/top drive 11 may then be raised in the direction of arrow 59, causing the alternative lower bail section 150 to rotate in the direction of arrow 56 until its longitudinal axis 165 is in vertical or parallel alignment with the longitudinal axis 115 upper bail portion 100, as shown in FIG. 34.

In one embodiment, when alternative lower bail section 150 rotates in the direction of arrow 56 the splines/male support lugs 630,630',660,660' of male connector 600 of lower bail section 150, and splines/support lugs 230,230', 260,260' of the female connector 200 of upper bail section 100 intermesh, which allow for a quick connect of alternative lower bail section 150 to upper bail section 100.

A rotational locking mechanism (such as locking wedge/tab 720 and/or 760) may be activated rotationally locking in position the interchanging of the bail portions 100 and 150 is completed, all steps occurring while the upper bail portion 100 remains attached to the link tilt system 30 of the top drive 11, and alternatively also while alternative lower bail section 150 remains at least above a predefined height 1020 above the rig floor 1000.

Figure 35:
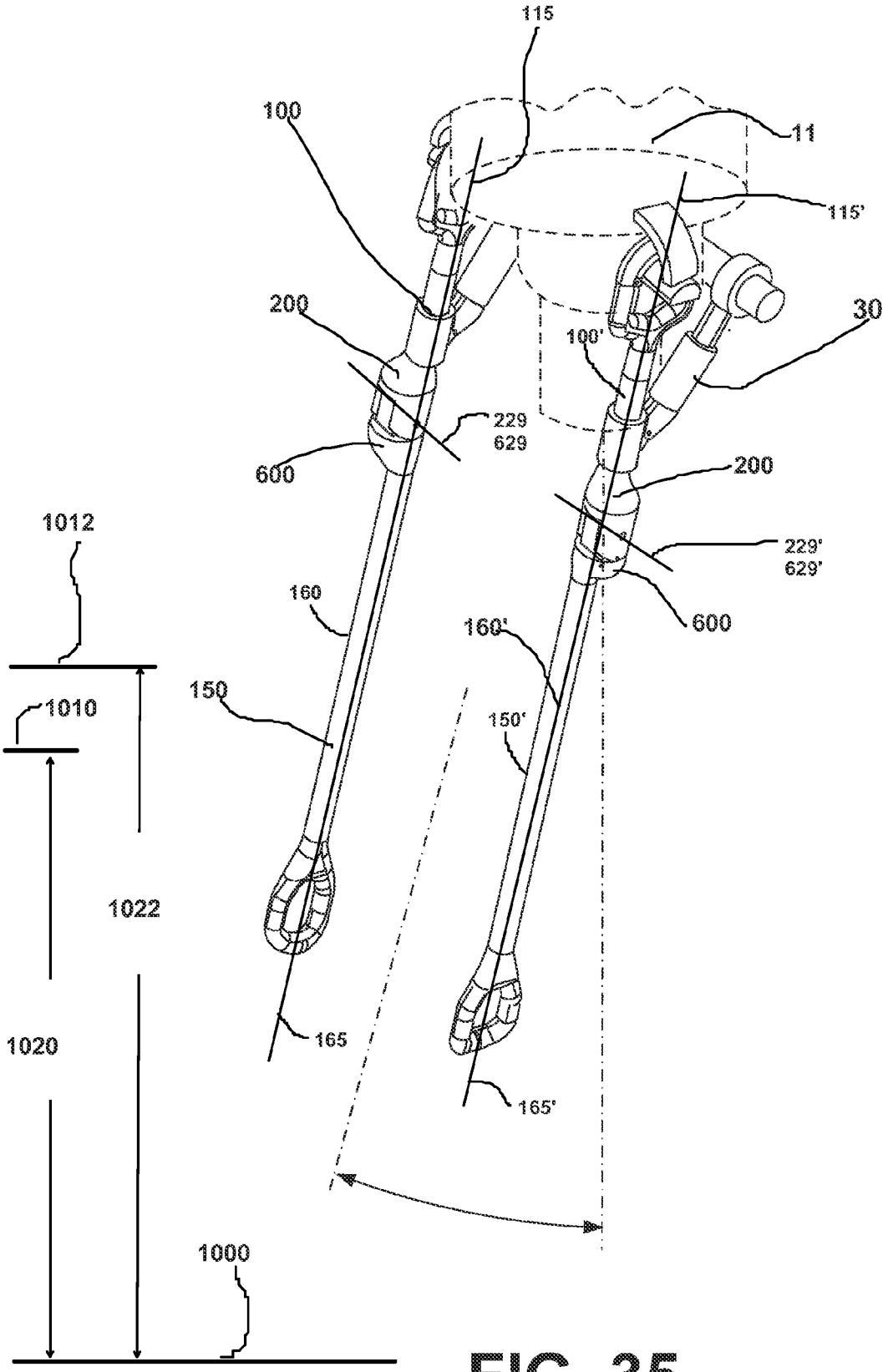
FIG. 35 schematically shows the locked bail link system of second length and second capacity FIG. 34 now lowered by the top drive from the link changing position shown in FIG. 34.

FIG. 35 schematically shows the locked bail link system of second length and second capacity of FIG. 34 now lowered by the top drive 11 from the link changing position shown in FIG. 34.

Figure 36:
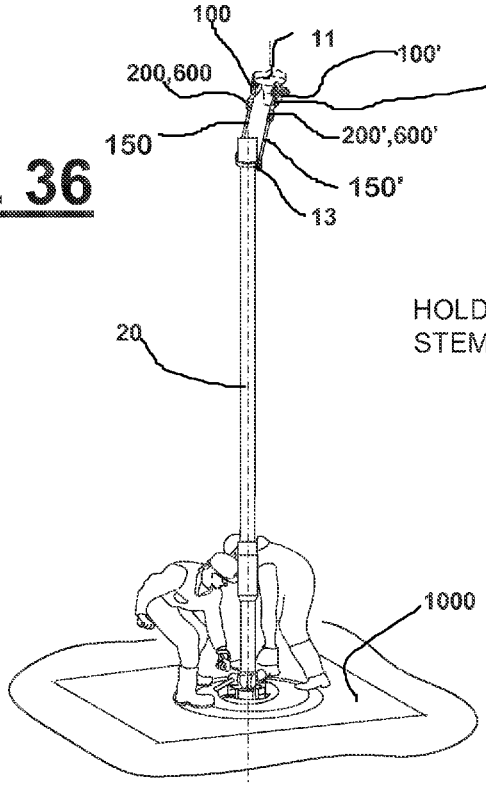
FIG. 36 schematically shows the locked bail link system of second length and second capacity FIG. 34 being used to support a joint of drill pipe.

FIG. 36 schematically shows the locked bail link system of second length and second capacity of FIG. 34 (upper link portion 100/lower link portion 150 and upper link portion 100'/lower link portion 150') being used to support a joint of drill pipe 20.

FIG. 37 schematically shows the bail link system of FIG. 34 (upper link portion 100/lower link portion 150 and upper link portion 100'/lower link portion 150') again being changed from the bail links of second length and second capacity 150/150' to another selected lower bail link selection where at least a predefined lower spacing 1020 is maintained during the switching process.

The result is a safe, efficient means to change the overall bail configuration without removing the upper bail section. The method of interchanging bail links also helps eliminate the need to work at heights and a need to disconnect the link tilt system from the bail system.

LIST OF REFERENCE NUMERALS

The following is a list of reference numerals:

| Reference Number | Description |
|---|---|
| 10 | interchangeable elevator bail or link |
| 11 | top drive |
| 13 | elevator |
| 14 | eyelet |
| 20 | tubular or drill pipe joint |
| 30 | link tilt system/mechanism |
| 50 | arrow |
| 52 | arrow |
| 54 | arrow |
| 56 | arrow |
| 58 | arrow |
| 59 | arrow |
| 60 | arrow |
| 62 | arrow |
| 70 | arrow |
| 72 | arrow |
| 100 | upper bail portion |
| 104 | first end |
| 106 | second end |
| 110 | rod or link |
| 115 | longitudinal axis |
| 120 | first lower bail portion |
| 124 | first end |
| 126 | second end |
| 130 | rod or link |
| 135 | longitudinal axis |
| 150 | second lower bail portion |
| 154 | first end |
| 156 | second end |
| 160 | rod or link |
| 165 | longitudinal axis |
| 190 | relative angular rotation |
| 200 | lockable female connector portion |
| 202 | mouth |
| 203 | gap |
| 204 | first end |

-continued

| Reference Number | Description |
|---|---|
| 205 | base of mouth |
| 208 | second end |
| 209 | enlarged section |
| 210 | upper arm |
| 220 | lower arm |
| 224 | substantially planar surface |
| 225 | substantially planar surface |
| 228 | bore hole |
| 229 | centerline |
| 230 | first load bearing lug/flank |
| 231 | first curved surface |
| 232 | second curved surface |
| 233 | inner radius of curvature |
| 235 | flat section |
| 236 | outer radius of curvature |
| 240 | first end |
| 242 | second end |
| 250 | height |
| 260 | second load bearing lug/flank |
| 264 | radius of curvature |
| 266 | flat sections |
| 270 | first end |
| 272 | second end |
| 280 | height |
| 282 | width |
| 300 | locking track |
| 310 | first track opening |
| 312 | depth |
| 314 | width |
| 320 | second track opening |
| 322 | depth |
| 324 | width |
| 340 | outer connecting track |
| 341 | outer radius of curvature |
| 342 | depth |
| 344 | width |
| 346 | radius of curvature |
| 350 | inner connecting track |
| 352 | depth |
| 354 | width |
| 356 | radius of curvature |
| 500 | lower bail portion |
| 510 | first end |
| 520 | second end |
| 530 | rod or link |
| 600 | lockable male connector portion |
| 603 | height |
| 604 | first end |
| 605 | height |
| 608 | second end |
| 609 | enlarged section |
| 610 | curved section |
| 612 | flat planar wall |
| 620 | male extension |
| 624 | substantially planar surface |
| 628 | bore hole |
| 629 | centerline |
| 630 | first load bearing lug/flank |
| 631 | height |
| 632 | width |
| 633 | inner radius of curvature |
| 634 | middle radius of curvature |
| 635 | outer radius of curvature |
| 636 | top to bottom dimension |
| 637 | side to side dimension |
| 638 | spacing between load bearing lugs |
| 639 | overall top to bottom dimension |
| 640 | first end |
| 642 | second end |
| 645 | arc length |
| 650 | height |
| 657 | side to side dimension |
| 660 | second load bearing lug/flank |
| 661 | height |
| 662 | width |
| 663 | inner radius of curvature |
| 664 | middle radius of curvature |

-continued

| Reference Number | Description |
|---|---|
| 665 | outer radius of curvature |
| 666 | top to bottom dimension |
| 667 | side to side dimension |
| 670 | first end |
| 672 | second end |
| 675 | arc length |
| 680 | height |
| 690 | gap |
| 700 | plurality of locking screws |
| 710 | first locking screw |
| 711 | head |
| 712 | threaded portion of borehole |
| 716 | receiving area |
| 718 | connection |
| 719 | removed portion |
| 720 | locking wedge or tab |
| 721 | top |
| 722 | width |
| 726 | depth |
| 728 | arrow |
| 750 | second locking screw |
| 751 | head |
| 752 | threaded portion of borehole |
| 756 | receiving area |
| 758 | connection |
| 759 | removed portion |
| 760 | locking wedge or tab |
| 761 | top |
| 762 | width |
| 766 | depth |
| 768 | arrow |
| 800 | turning rod |
| 802 | arrow |
| 804 | arrow |
| 806 | arrow |
| 810 | first end |
| 820 | second end |
| 830 | head |
| 900 | load bearing surface |
| 901 | load bearing surface |
| 902 | load bearing surface |
| 903 | load bearing surface |
| 1000 | rig floor |
| 1010 | lowest point of original link during a change |
| 1020 | lowest vertical spacing from rig floor shortly before a change in links is made |
| 1022 | lower vertical spacing from rig floor when lower link is raised 90 degrees |
| 1200 | hoist |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. An interchangeable elevator bail link system for changing elevator length and load carrying configurations during oil rig operations, comprising:

(a) an upper bail section comprising first and second ends and an upper longitudinal axis, wherein the upper bail section is connected to a link tilt system of a top drive or traveling block, and the second end of the upper bail section includes an upper detachable connecting profile; and (b) one or more lower bail sections wherein each of the one or more lower bail sections includes a lower longitudinal axis, a lower connector for connecting to an elevator, and a lower detachable connecting profile which can detachably and rotatably connect to the upper detachable connecting profile of the upper bail section; and (c) wherein connection of the upper and lower detachable connecting profiles is effected by changing state of the upper and lower longitudinal axes from a non-parallel state to a parallel state, and the upper and lower detachable connecting profiles are disconnected from each other by changing state of the upper and lower longitudinal axes from a parallel state to a non-parallel state.

2. The system of claim 1, wherein in changing state of the upper and lower detachable connecting profiles, the lower detachable connecting profile rotates about an axis which is perpendicular to the longitudinal axis of the upper bail section.

3. The system of claim 2, wherein the lower detachable connecting profile rotates at between 45 and 90 degrees.

4. The system of claim 1, wherein in changing state of the upper and lower detachable connecting profiles, the upper detachable connecting profile rotates about an axis which is perpendicular to the longitudinal axis of the lower bail section.

5. The system of claim 4, wherein the lower detachable connecting profile rotates between 45 and 90 degrees.

6. The system of claim 4 wherein the upper bail section comprises a fixed length of approximately five feet (1.5 Meters) and a 500 Ton (453,592 Kilograms) capacity, and at least one lower bail section comprises a length of four feet (1.2 Meters) and a 350 Ton (317,514 Kilograms) capacity for connecting to the upper bail section during drilling and tripping operations, and wherein at least one of the lower bail sections comprises a length of thirteen feet (4.0 Meters) and a 500 Ton (453,592 Kilograms) capacity for connecting to the upper bail section for running casing operations.

7. The system of claim 1 wherein in changing state of the upper and lower detachable connecting profiles, the upper and lower bail sections rotate relative to each other in the same plane.

8. The system of claim 1, wherein the upper and lower detachable connecting profiles each have at least one cooperating load bearing lug/flank.

9. The system of claim 8, wherein the at least one cooperating load bearing lug/flank of the upper detachable connecting profile has a finite radius of curvature and the at least one cooperating load bearing lug/flank of the lower detachable connecting profile has a radius of curvature that is substantially the same as but of opposite concavity to the radius of curvature of the load bearing lug/flank of the upper detachable connecting profile and these matching radii of curvature facilitate relative rotation between the upper and lower detachable connecting profiles.

10. The system of claim 1, wherein the upper and lower detachable connecting profiles each have at least first and second cooperating load bearing lug/flanks, wherein the cooperating first load bearing lug/flank of the upper detachable connecting profile has a finite radius of curvature and the cooperating first load bearing lug/flank of the lower detachable connecting profile has a radius of curvature that is substantially the same as but of opposite concavity to the radius of curvature of the first load bearing lug/flank of the upper detachable connecting profile, the cooperating second load bearing lug/flank of the upper detachable connecting profile has a finite radius of curvature and the cooperating second load bearing lug/flank of the lower detachable connecting profile has a radius of curvature that is substantially the same as but of opposite concavity to the radius of curvature of the second load bearing lug/flank of the upper detachable connecting profile, and these multiple matching radii of curvature facilitate relative rotation between the upper and lower detachable connecting profiles.

11. The system of claim 1, wherein the upper and lower detachable connecting profiles each have (a) top first and second cooperating load bearing lug/flanks, wherein the cooperating top first load bearing lug/flank of the upper detachable connecting profile has a finite radius of curvature and the cooperating top first load bearing lug/flank of the lower detachable connecting profile has a radius of curvature that is substantially the same as but of opposite concavity to the radius of curvature of the top first load bearing lug/flank of the upper detachable connecting profile, the cooperating top second load bearing lug/flank of the upper detachable connecting profile has a finite radius of curvature and the cooperating top second load bearing lug/flank of the lower detachable connecting profile has a radius of curvature that is substantially the same as but of opposite concavity to the radius of curvature of the top second load bearing lug/flank of the upper detachable connecting profile, and (b) bottom first and second cooperating load bearing lug/flanks, wherein the cooperating bottom first load bearing lug/flank of the upper detachable connecting profile has a finite radius of curvature and the cooperating bottom first load bearing lug/flank of the lower detachable connecting profile has a radius of curvature that is substantially the same as but of opposite concavity to the radius of curvature of the bottom first load bearing lug/flank of the upper detachable connecting profile, the cooperating bottom second load bearing lug/flank of the upper detachable connecting profile has a finite radius of curvature and the cooperating bottom second load bearing lug/flank of the lower detachable connecting profile has a radius of curvature that is substantially the same as but of opposite concavity to the radius of curvature of the bottom second load bearing lug/flank of the upper detachable connecting profile, and (c) these multiple matching radii of curvature facilitate relative rotation between the upper and lower detachable connecting profiles.

12. The system of claim 1, wherein a detachable rotation rod is rotatably connected to at least one of the upper or lower detachable connecting profiles.

13. The system of claim 1 wherein the one or more lower bail sections include lower bail sections comprising different lengths and tonnage capacities, wherein said lower bail sections may be interchangeably connected to the upper bail section while the upper bail section remains attached to the link tilt system of the top drive or traveling block.

14. The system of claim 2 wherein the upper bail section comprises a fixed length.

15. A method of operating a drilling rig with an elevator bail link assembly comprising the following steps:

(a) providing a bail system comprising:

(i) an upper bail section comprising first and second ends and an upper longitudinal axis, wherein the upper bail section is connected to a link tilt system of a top drive or traveling block, and the second end of the upper bail section includes a first connector having an upper detachable connecting profile; and (ii) one or more lower bail sections wherein each of the one or more lower bail sections includes a lower longitudinal axis, a second connector for connecting to an elevator, and a third connector having a lower detachable connecting profile which can detachably and rotatably connect to the upper detachable connecting profile of the upper bail section; and (iii) wherein the upper and lower detachable connecting profiles are connected to each other by changing the state of the upper and lower longitudinal axes from a non-parallel state to a parallel state, and the upper and lower detachable connecting profiles are disconnected from each other by changing the state of the upper and lower longitudinal axes from a parallel state to a non-parallel state;

(b) selecting a lower bail section comprising a fixed length and tonnage capacity for use in a particular oil rig operation;

(c) positioning the one or more lower bail sections in horizontal or nonparallel relation to the upper bail section, which upper bail section is positioned along a longitudinal axis;

(d) causing the lower bail section to be raised relative to the upper bail section until positioning holes located on the first and third connectors of the lower and upper bail sections align;

(e) inserting a positioning pin through the positioning holes of the first and third connectors of the lower and upper bail sections;

(f) causing the lower bail section to rotate relative to the upper bail section to change the state of the upper and lower longitudinal axes from a non-parallel state to a parallel state, wherein the first and third connectors of the lower bail and upper bail sections mesh; and (g) connecting the lower bail section second connector to a hoisting elevator.

16. The method of claim 15, wherein in step "c" in changing state of the upper and the lower detachable connecting profiles, the lower detachable connecting profile rotates about an axis which is perpendicular to the upper longitudinal axis of the upper bail section.

17. The method of claim 16, wherein in step "c" the lower detachable connecting profile rotates at between 45 and 90 degrees.

18. The method of claim 15, wherein in step "c" in changing state of the upper and lower detachable connecting profiles, the upper detachable connecting profile rotates about an axis which is perpendicular to the lower longitudinal axis of the lower bail section.

19. The method of claim 18, wherein in step "c" the lower detachable connecting profile rotates between 45 and 90 degrees.

20. The method of claim 15, wherein in step "c" in changing state of the upper and lower detachable connecting profiles, the upper and lower bail links rotate relative to each other in the same plane.

21. The method of claim 15, wherein in step "a" the upper and lower detachable connecting profiles each have at least one cooperating load bearing lug/flank.

22. The method of claim 21, wherein the at least one cooperating load bearing lug/flank of the upper detachable connecting profile has a finite radius of curvature and the cooperating load bearing lug/flank of the lower detachable connecting profile has a radius of curvature that is substantially the same as but of opposite concavity to the radius of curvature of the load bearing lug/flank of the upper detachable connecting profile and these matching radii of curvature facilitate relative rotation between the upper and lower detachable connecting profiles.

23. The method of claim 15, wherein in step "a" the upper and lower detachable connecting profiles each have at least first and second cooperating load bearing lug/flanks, wherein the cooperating first load bearing lug/flank of the upper detachable connecting profile has a finite radius of curvature and the cooperating first load bearing lug/flank of the lower detachable connecting profile has a radius of curvature that is substantially the same as but of opposite concavity to the radius of curvature of the first load bearing lug/flank of the upper detachable connecting profile, the cooperating second load bearing lug/flank of the upper detachable connecting profile has a finite radius of curvature and the cooperating second load bearing lug/flank of the lower detachable connecting profile has a radius of curvature that is substantially the same as but of opposite concavity to the radius of curvature of the second load bearing lug/flank of the upper detachable connecting profile, and these multiple matching radii of curvature facilitate relative rotation between the upper and lower detachable connecting profiles.

24. The method of claim 15, wherein in step "a" the upper and lower detachable connecting profiles each have:

(a) top first and second cooperating load bearing lug/flanks, wherein the cooperating top first load bearing lug/flank of the upper detachable connecting profile has a finite radius of curvature and the cooperating top first load bearing lug/flank of the lower detachable connecting profile has a radius of curvature that is substantially the same as but of opposite concavity to the radius of curvature of the top first load bearing lug/flank of the upper detachable connecting profile, the cooperating top second load bearing lug/flank of the upper detachable connecting profile has a finite radius of curvature and the cooperating top second load bearing lug/flank of the lower detachable connecting profile has a radius of curvature that is substantially the same as but of opposite concavity to the radius of curvature of the top second load bearing lug/flank of the upper detachable connecting profile, and (b) bottom first and second cooperating load bearing lug/flanks, wherein the cooperating bottom first load bearing lug/flank of the upper detachable connecting profile has a finite radius of curvature and the cooperating bottom first load bearing lug/flank of the lower detachable connecting profile has a radius of curvature that is substantially the same as but of opposite concavity to the radius of curvature of the bottom first load bearing lug/flank of the upper detachable connecting profile, the cooperating bottom second load bearing lug/flank of the upper detachable connecting profile has a finite radius of curvature and the cooperating bottom second load bearing lug/flank of the lower detachable connecting profile has a radius of curvature that is substantially the same as but of opposite concavity to the radius of curvature of the bottom second load bearing lug/flank of the upper detachable connecting profile, and (c) these multiple matching radii of curvature facilitate relative rotation between the upper and lower detachable connecting profiles.

25. The method of claim 15, wherein in step "c" a detachable rotation rod is rotatably connected to at least one of the upper or lower detachable connecting profiles.

26. The method of claim 15, wherein in step "a" the one or more lower bail sections include lower bail sections comprising different lengths and tonnage capacities, wherein said lower bail sections may be interchangeably connected to the upper bail section while the upper bail system remains attached to the link tilt system of the top drive or traveling block.

27. The method of claim 26 wherein detaching each of the one or more lower bail sections for interchanging another set of one or more lower bail sections is accomplished simultaneously.

28. The method of claim 26 wherein the one or more lower bail sections are each supported by a single cradle above a floor level while connecting a selected set of one or more lower bail sections or detaching a selected set of one or more lower bail sections.

29. The method of claim 28 wherein the single cradle also supports an elevator.

30. The method of claim 26 wherein the one or more lower bail sections are each supported by a different cradle above a floor level while connecting a selected set of one or more lower bail sections or detaching a selected set of one or more lower bail sections.

31. The method of claim 15, further comprising the step of using a locking system having a locking component to prevent the lower bail section from rotating back to a horizontal position.

32. The method of claim 31, further comprising the steps of removing the locking component and moving the top drive or traveling block to cause the lower bail section to return to a horizontal or nonparallel position, and disconnecting the lower bail section from the hoisting elevator and upper bail section, while the upper bail section remains attached to the link tilt system.

33. The method of claim 32, further comprising the steps of selecting a lower bail section having a different length and tonnage capacity and repeating steps (d)-(g).

34. The method of claim 15 wherein the connection of each of the one or more lower bails is accomplished simultaneously.

35. The method of claim 15 wherein the connection of each of the one or more lower bail sections is not accomplished simultaneously.

36. The method of claim 35 wherein detaching each of the one or more lower bail sections is not accomplished simultaneously.

37. An interchangeable bail system comprising (a) an upper bail section detachably connectable to a link tilt system of a top drive or traveling block, (b) multiple lower bail sections of varying lengths and tonnage capacities detachably connectable to an elevator and to the upper bail section, (c) a connector system that effects connection between the upper and lower bail sections, and (d) wherein a selected lower bail section connected to the upper bail section determines the tonnage capacity and length of the bail system, and wherein the tonnage capacity and/or length of the bail system can be changed by exchanging one selected lower bail section for another lower bail section having a different length and/or tonnage capacity and wherein the tonnage capacity and/or length of the bail system is changeable without detaching the upper bail section from the top drive or traveling block.

38. The system in claim 37, wherein the connector system incorporates a rotational torque stop.

39. The system in claim 38, wherein the upper bail section includes a female connection and each of the multiple lower bail sections include a male connection, and wherein the upper and a selected lower bail section of the multiple lower bail sections are threaded together via the male and female connections.

40. The system in claim 37, wherein the connector system is manually placed.

41. The system in claim 37, wherein the connector system is automatic.

42. The system in claim 37, wherein the connector system is spring loaded and effects connection between the upper bail section and a selected lower bail section.

43. The system in claim 37, wherein the bail sections are mated directly with opposing profiles.

44. The system in claim 37, wherein the bail sections are mated with a ball and recess system.

45. The system in claim 37, wherein the bail sections are mated with a grapple system.

46. The system in claim 37, wherein the upper and lower bail sections, and/or the connector system, incorporate a locking assembly.

47. The system in claim 37, wherein the connector system is hydraulically operated.

48. The system in claim 37, wherein the connector system is pneumatically operated.

49. The system in claim 37, wherein the connector system is electrically operated.

50. The system in claim 37, wherein the connector system is mechanically operated.

51. An interchangeable bail system comprising (a) an upper bail section having an upper connecting profile, (b) a plurality of lower bail sections of varying lengths and tonnage capacities wherein each of the plurality of lower bail sections has a lower connecting profile and is detachably connectable to the upper bail section, and (c) a rotatable connector system having a rotational torque stop that effects a detachable connection between the upper bail section connecting profile and one of said lower bail section lower connecting profiles selected for connection to the upper bail section, wherein the rotatable connector system transfers loads via splines and effects a connection between the upper bail section and one of said lower bail sections selected for connection to the upper bail section.

52. The system in claim 51, wherein the splines are tapered end to end to allow easy intermeshing on initial engagement and close tolerances on final engagement.

53. The system in claim 51, wherein the splines are dovetailed on one side or both.

54. An interchangeable bail system comprising (a) an upper bail section having an upper connecting profile, (b) a plurality of lower bail sections of varying lengths and tonnage capacities wherein each of the plurality of lower bail sections has a lower connecting profile, and (c) a rotatable connector system having a rotational torque stop that effects a detachable connection between the upper bail section connecting profile and one of said lower bail section lower connecting profiles selected for connection to the upper bail section.

* * * * *